US007642728B2

(12) United States Patent
Moisin

(10) Patent No.: US 7,642,728 B2
(45) Date of Patent: Jan. 5, 2010

(54) CIRCUIT HAVING EMI AND CURRENT LEAKAGE TO GROUND CONTROL CIRCUIT

(76) Inventor: Mihail S. Moisin, 8 Druce St., Brookline, MA (US) 02445

( * ) Notice: Subject to any disclaimer, the term of this patent is extended or adjusted under 35 U.S.C. 154(b) by 99 days.

(21) Appl. No.: 11/169,413

(22) Filed: Jun. 29, 2005

(65) Prior Publication Data

US 2005/0237008 A1 Oct. 27, 2005

Related U.S. Application Data

(63) Continuation-in-part of application No. 11/780,926, filed on Feb. 18, 2004, now Pat. No. 7,061,187, which is a continuation-in-part of application No. 10/685,781, filed on Oct. 15, 2003, now Pat. No. 6,954,036.

(60) Provisional application No. 60/455,752, filed on Mar. 19, 2003, provisional application No. 60/584,539, filed on Jul. 1, 2004.

(51) Int. Cl.
*G05F 1/00* (2006.01)
*H05B 37/00* (2006.01)

(52) U.S. Cl. ..... 315/291; 315/224

(58) Field of Classification Search ..... 315/200 R, 315/209 R, 224, 225, 226, 244, 227 R, 241 R, 315/242, 243, 276, 283, 291
See application file for complete search history.

(56) References Cited

U.S. PATENT DOCUMENTS 3,859,555 A 1/1975 Latassa et al.
4,580,013 A 4/1986 Moisin
4,829,567 A 5/1989 Moisin
4,864,609 A 9/1989 Moisin
4,922,531 A 5/1990 Moisin
5,014,305 A 5/1991 Moisin
5,052,039 A 9/1991 Moisin
5,081,401 A 1/1992 Moisin
5,124,619 A 6/1992 Moisin et al.
5,138,233 A 8/1992 Moisin et al.
5,138,234 A 8/1992 Moisin
5,138,236 A 8/1992 Bobel et al.
5,144,195 A 9/1992 Konopka et al.
5,148,087 A 9/1992 Moisin et al.
5,220,247 A 6/1993 Moisin
5,332,951 A 7/1994 Turner et al.
5,448,137 A * 9/1995 Bobel ..... 315/244
5,559,396 A * 9/1996 Bruning et al. ..... 315/291
5,583,402 A 12/1996 Moisin et al.
5,608,295 A * 3/1997 Moisin ..... 315/247
5,686,799 A 11/1997 Moisin et al.
5,691,606 A * 11/1997 Moisin et al. ..... 315/307
5,798,617 A * 8/1998 Moisin ..... 315/247

(Continued)

*Primary Examiner*—Douglas W Owens
*Assistant Examiner*—Minh D A
(74) *Attorney, Agent, or Firm*—Daly, Crowley, Mofford & Durkee, LLP

(57) ABSTRACT

A resonant circuit includes a feedback path for a feedback signal extending from a load terminal to an input terminal so that a potential of the load substantially tracks a potential of the input terminals. A resonant circuit extends from a load to a line terminal so that a potential of the load substantially tracks a potential of the line terminals. A resonant circuit includes a split inductor so that when the load increases so does the equivalent resonant inductance.

7 Claims, 24 Drawing Sheets

U.S. PATENT DOCUMENTS 5,821,699 A 10/1998 Moisin
5,866,993 A 2/1999 Moisin
5,877,926 A 3/1999 Moisin
5,925,986 A 7/1999 Moisin
5,955,841 A * 9/1999 Moisin et al. ..... 315/56
5,982,111 A 11/1999 Moisin
6,011,362 A 1/2000 Moisin
6,020,688 A 2/2000 Moisin
6,028,399 A 2/2000 Moisin
6,037,722 A 3/2000 Moisin
6,051,936 A 4/2000 Qian
6,069,455 A 5/2000 Moisin
6,091,288 A 7/2000 Moisin
6,100,645 A * 8/2000 Moisin ..... 315/224
6,100,648 A 8/2000 Moisin
6,107,750 A 8/2000 Moisin
6,122,182 A 9/2000 Moisin
6,127,786 A 10/2000 Moisin
6,137,233 A 10/2000 Moisin
6,157,142 A 12/2000 Moisin
6,160,358 A 12/2000 Moisin
6,169,375 B1 1/2001 Moisin
6,181,082 B1 1/2001 Moisin
6,181,083 B1 1/2001 Moisin
6,188,553 B1 2/2001 Moisin
6,194,843 B1 2/2001 Moisin
6,222,326 B1 4/2001 Moisin
6,236,168 B1 5/2001 Moisin
6,281,638 B1 8/2001 Moisin
6,337,800 B1 * 1/2002 Chang ..... 363/37
6,362,575 B1 * 3/2002 Chang et al. ..... 315/224
6,642,670 B2 * 11/2003 Zhang et al. ..... 315/247
2002/0011806 A1 1/2002 Moisin
2002/0030451 A1 3/2002 Moisin
2003/0160571 A1 8/2003 Moisin
2004/0090800 A1 5/2004 Moisin

* cited by examiner

| REF. DESIGN. | DESCRIPTION |
|---|---|
| L3 | Inductor Assy, 1.69mH (+/-3%), AL=100 |
| | 130T/10T, 3x33AWG Litz, 7pin, CS-L3 |
| L2 | Inductor Assy, 1.90mH, AL=65 |
| | 171T, 29AWGH, 5pin CS-L2 |
| L1 | Inductor Assy, 1.90mH, AL=65 |
| | 171T, 29AWGH, 5pin CS-L2 |
| T1 | Torroid Transformer, CS1 |
| | H40-T(9x4x5) (1-1-5)T |
| C3 | Capacitor, Ceramic, SMD, |
| | 0.1uF, 50Vdc, 10%, 1206 Pkg. |
| C1 | Capacitor, Metallized Polyester, 5mm |
| | 0.01uF, 400Vdc, 10% |
| C2 | Capacitor, Metallized Polyester, 5mm |
| | Epoxy-Dipped, 33nF, 250Vdc, 10% |
| C12 | Capacitor, Prypropylene, 5mm |
| | Epoxy-Dipped, 2.7nF, 400Vdc, 10% |
| C5 | Capacitor, Ceramic, Radial |
| | 100pF, 1000Vdc, 5mm |
| C8 | Capacitor, Prypropylene, 5mm |
| | Epoxy-Dipped, 2.2nF, 1500V, 10% |
| C10 | Capacitor, Prypropylene, 5mm |
| | Epoxy-Dipped, 4.7nF, 400Vdc, 10% |
| CO1, CO2 | Capacitor, Electrolytic, (10x20)mm |
| | 33uF, 200Vdc, 105C, 5mm |
| D5 | Diode, Axial, Glass-Passivated |
| | Fast, 1000V, 1N4007GP |
| D1-D4, D9-D10 | Diode, Axial, Glass-Passivated |
| | Ultra-Fast, 1000V, UF4007GP |
| D6 | Diac, Axial, 32V Db-3 |
| RF | Fuse, Axial |
| | 3A/250V |
| R7, R15 | Resistor, SMD, 1206 Pkg, |
| | 0 Ohm |
| R8, R11, R12 | Resistor, SMD, 1206 Pkg, |
| R14, R20, R21 | 0 Ohm |
| R6, R10, R13, R16 | Resistor, SMD, 1206 Pkg, |
| NOT USED | |
| R3 | Resistor, SMD, 1206 Pkg, |
| | 33 Ohm, 5%, 1/4W |
| R5, R9 | Resistor, SMD, 1206 Pkg, |
| | 20 Ohm, 1%, 1/4W |
| R1, R2 | Resistor, SMD, 1206 Pkg, |
| | 150 kOhm, 5%, 1/4W |
| R4 | Resistor, SMD, 1206 Pkg, |
| | 300 kOhm, 5%, 1/4W |
| R17-R19 | Resistor, SMD, 1206 Pkg, |
| NOT USED | |
| Q1, Q2 | Transistor Power, TO-220 |
| | ST13005 |
| J1, J1 | Terminal, Radial |
| | 2 pin, CSI |
| TH1 | Thermister, PTC |
| NOT USED | |

*FIG. 17*

CIRCUIT HAVING EMI AND CURRENT LEAKAGE TO GROUND CONTROL CIRCUIT

CROSS REFERENCE TO RELATED APPLICATIONS

The present application claims the benefit of U.S. Provisional Patent application No. 60/584,539, filed on Jul. 1, 2004, and is a continuation-in-part of U.S. patent application Ser. No. 10/780,926, filed on Feb. 18, 2004, which is now U.S. Pat. No. 7,061,187, which is a continuation-in-pan of U.S. patent application Ser. No. 10/685,781, filed on Oct. 15, 2003, which is now U.S. Pat. No. 6,954,036, which claims the benefit of U.S. Provisional Patent Application No. 60/455,752, filed on Mar. 19, 2003, all of which are incorporated herein by reference.

STATEMENT REGARDING FEDERALLY SPONSORED RESEARCH

Not Applicable.

FIELD OF THE INVENTION

The present invention relates generally to electrical circuits and, more particularly, to electrical circuits for controlling power to a load.

BACKGROUND OF THE INVENTION

As is known in the art, there are a variety of circuits for energizing a load that attempt to improve the overall circuit performance. Some circuits utilize feedback from a load to bias components, such as diodes, to the conductive state to enable more efficient charging of storage capacitors, for example. Exemplary power control, dimming, and/or feedback circuits are shown and described in U.S. Pat. Nos. 5,686,799, 5,691,606, 5,798,617, and 5,955,841, all of which are incorporated herein by reference.

FIG. 1 shows an exemplary prior art resonant circuit having a feedback path FB via a series capacitor Cs to a point PFB between diodes D1, D2 that form a voltage doubler circuit. An input filter IF includes an inductor L1 and a capacitor C1 to limit the energy from the resonant circuit that goes back out on the line via the input terminals, which can correspond to conventional white and black wires WHT, BLK. While the voltage level of the feedback signal applied to the diodes D1, D2 can be increased by resonance between the various LC elements CF, LR1, LR2, the amount of feedback is limited to an acceptable amount of electromagnetic interference generated by a portion of the feedback signal flowing back out through the input inductor L1 and capacitor C1. That is, some known circuits having feedback from the load can generate significant Electromagnetic Conductive interference (EMC) that degrades circuit performance and limits use of the feedback.

One problem arising in known Compact Fluorescent Lamps (CFL) is the high load voltage against ground, especially under dimming conditions. CFLs are prone to developing high voltages when dimmed, which in turn generate a high level of Electromagnetic Interference (EMI) on one hand and a parasitic lamp current leakage to ground on the other hand, thus significantly reducing the life expectancy of the lamp.

It would, therefore, be desirable to overcome the aforesaid and other disadvantages.

SUMMARY OF THE INVENTION

The present invention provides a resonant circuit using feedback from a load to promote linear operation of rectifying diodes while limiting electromagnetic conduction interference from the feedback signal. With this arrangement, a clamped amount of the high frequency load feedback signal can be used to maintain rectifying diodes in a conductive state so as to make non-linear loads appear linear. While the invention is primarily shown and described in conjunction with a ballast circuit energizing a fluorescent lamp, it is understood that the invention is applicable to circuits in general in which a feedback signal can enhance circuit performance.

In one embodiment, a circuit includes first and second input terminals for receiving an AC input signal and an input inductor having a first end coupled to the first terminal. The circuit further includes a feedback path for transferring a signal from a load to a second end of the first inductor and a blocking capacitor coupled in parallel with the input inductor so as to form a notch filter tuned to a frequency of the load signal on the feedback path. With this arrangement, the entire load current can be provided as feedback to rectifying diodes to promote linear operation of the diodes while the notch filter blocks energy from the feedback signal from going back out onto the line.

In another aspect of the invention, a circuit, such as a resonant ballast circuit, includes a load inductor inductively coupled to a resonant inductor and a Positive Temperature Coefficient (PTC) element that combine to provide a soft start for a load, which can correspond to a fluorescent lamp.

In a further aspect of the invention, a resonant circuit includes a clamped feedback signal for providing a load current signal envelope that substantially tracks an input signal. With this arrangement, circuit efficiency is enhanced by the linear operation of the circuit.

In another aspect of the invention, a resonant circuit includes a voltage feedback taken from a point between the load terminals to one or both of input terminals. With this arrangement the load is referenced to the line, thus minimizing the load voltage against ground and consequently reducing the leakage current to ground and the Electromagnetic Interference (EMI).

The voltage developed between at least one of the load terminals and ground can easily be in the range of 1.6 kVpp, generating a parasitic leakage current to ground. A typical CFL is not designed to withstand this type of leakage current to ground, which effectively flows through the glass of the lamp. Without controlling this parasitic leakage current to ground the life expectancy of the lamp can be significantly shortened, e.g., by a factor of 100-from an average of 6,000 hr to less than 60 hr. In addition, this parasitic current to ground will find its way over the power line, thus generating an elevated level of EMI.

BRIEF DESCRIPTION OF THE DRAWINGS

The invention will be more fully understood from the following detailed description taken in conjunction with the accompanying drawings, in which:

FIG. 17 is a textual representation showing exemplary component values for the circuit of FIG. 16;

DETAILED DESCRIPTION OF THE INVENTION

Figure 1:
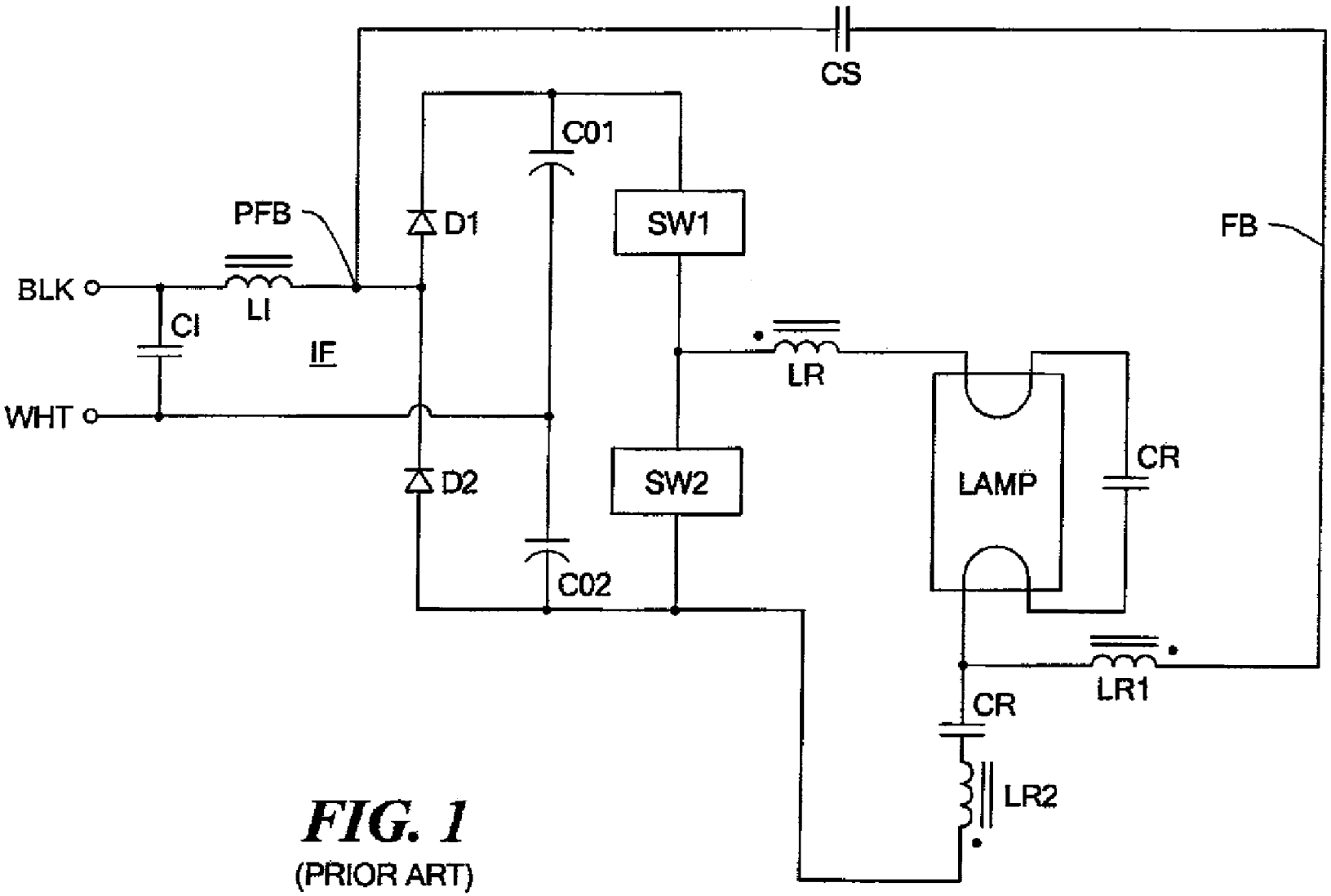
FIG. 1 (PRIOR ART)
FIG. 1 is a schematic diagram of a prior art circuit having feedback from a load.
Figure 2:
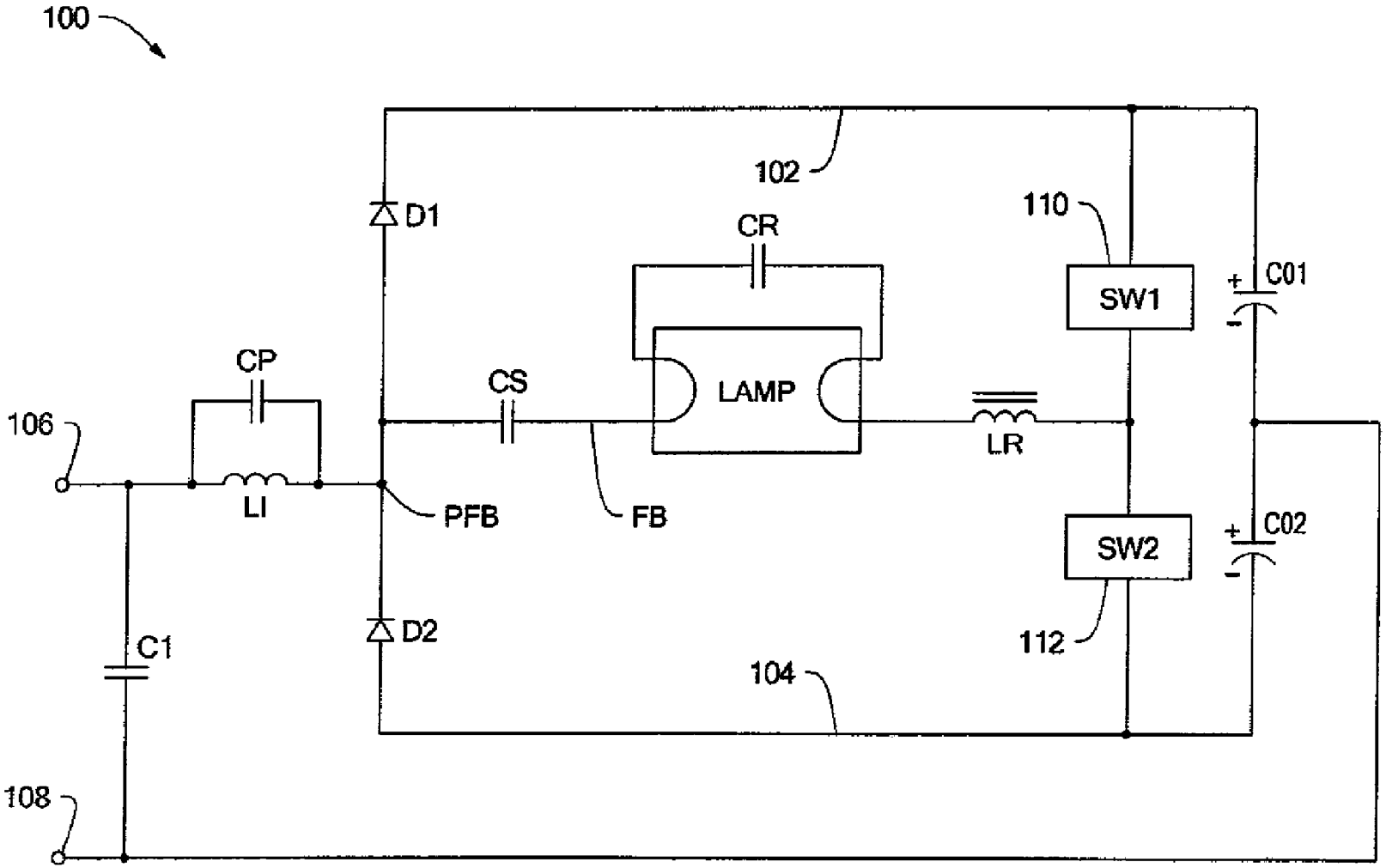
FIG. 2 is a schematic depiction of a circuit having a feedback path in accordance with the present invention.

FIG. 2 shows an exemplary circuit 100 having a feedback path FB from the load LD, here shown as a fluorescent lamp (a non-linear load), to a point PFB between first and second diodes D1, D2 coupled across first and second rails 102, 104 in a voltage doubler configuration. The feedback path FB can include a series capacitor CS coupled between the load LD and the feedback point PFB.

First and second storage capacitors C01, C02 are coupled end-to-end across the rails 102, 104. A first input terminal 106, which can correspond to a conventional black wire, is coupled via an input inductor L1 to the feedback point PFB between the diodes D1, D2. A second input terminal 108, which can correspond to a conventional white wire, is coupled to a point between the first and second capacitors C01, C02. An input capacitor C1 can be coupled between the first and second terminals 106, 108.

In one particular embodiment, the resonant circuit 100 includes first and second switching elements 110, 112 coupled in a half bridge configuration for energizing a load. The resonant circuit 100 includes a resonant inductor LR, a resonant capacitor CR, and a load LD, such as a fluorescent lamp. It is understood that the load can be provided from a wide variety of resonant and non-resonant, linear and non-linear circuits, devices and systems. It is further understood that the switching elements can be provided in a variety of topologies, such as full bridge arrangements, without departing from the present invention. In addition, the switching elements can be selected from a wide variety of device types well known to one of ordinary skill in the art.

The circuit 100 further includes a blocking capacitor CP coupled in parallel across the input inductor L1. The impedance of the blocking capacitor CP is selected to resonate in parallel with the input inductor L1 at a frequency representative of the feedback signal, which corresponds to an operating frequency of the load. The blocking capacitor CP and the input inductor L1 provide a notch filter at the frequency of the feedback signal so as to block energy from the feedback signal from going back out onto the line through the input terminals 106, 108. The notch filter allows minimal current flow from the feedback signal through the input capacitor C1 and input inductor L1.

Since the path back out onto the line is blocked, substantially all of the feedback signal energy, which can correspond to the entire load current, is directed to maintaining the diodes D1, D2 in a conductive state. The high frequency feedback signal biases the diodes D1, D2 to the conductive state, which facilitates the flow of energy from the line to the storage capacitors C01, C02. With this arrangement, a non-linear load appears to be linear.

Figure 3:
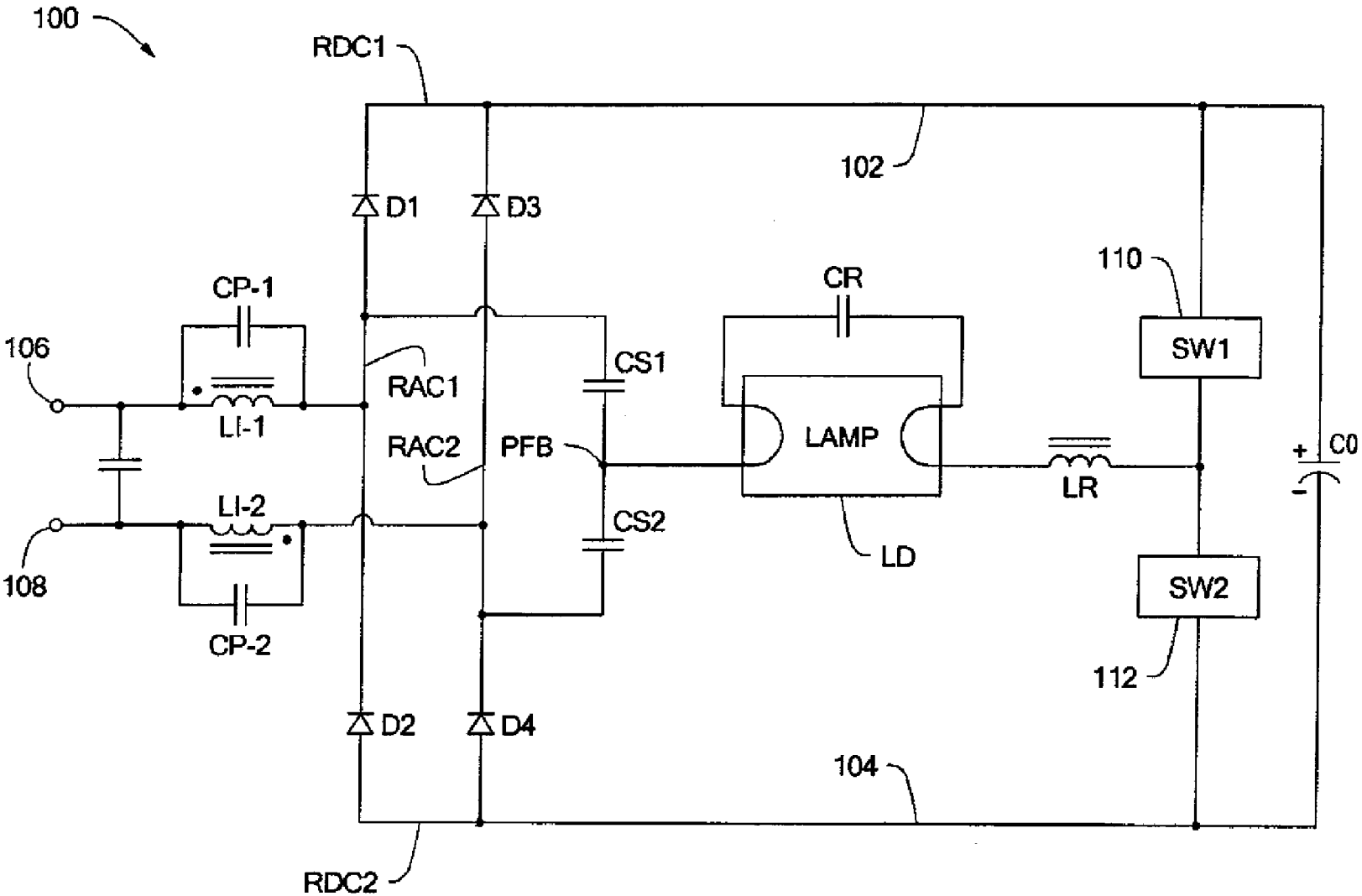
FIG. 3 is a schematic depiction of a further circuit having a feedback path in accordance with the present invention.

FIG. 3 shows another embodiment 100' having enhanced linear operation similar to that of FIG. 2, where like reference designations indicate like elements. The circuit 100' includes a full bridge rectifier D1, D2, D3, D4 having first and second series capacitors CS1, CS2 coupled end-to-end between AC terminals RAC1, RAC2 of the rectifier. A storage capacitor C0 is coupled across the DC rails RDC1, RDC2. A feedback path FB extends from the load LD, here shown as a lamp, to a point PFB between the first and second series capacitors C1, C2.

A first input inductor L1-1 is located at the first input terminal 106 and a second input inductor L1-2, which can be inductively coupled with the first input inductor L1-1, is located at the second input terminal 108. It is understood that the input inductors L1-1, L1-2 can be coupled or independent depending upon the needs of a particular application. A first blocking capacitor CP-1 is coupled in parallel with the first input inductor L1-1 to form a notch filter tuned to the feedback signal from the load LD. A second blocking capacitor CP-2 is coupled in parallel with the second input inductor L1-2 to also form a notch filter tuned to the feedback signal.

In one particular embodiment, the impedance of the first and second input inductors L1-2, L1-2 are substantially the same and the impedance of the first and second blocking capacitors CP-1, CP-2 is substantially the same.

With this arrangement, energy from the feedback signal FB is directed to maintaining the full bridge rectifier diodes D1-D4 in the conductive state since the notch filters L1-1, CP-1 and L1-2, CP-2 block energy from the feedback signal from going back out on the line and thereby minimize EMC levels.

Figure 4:
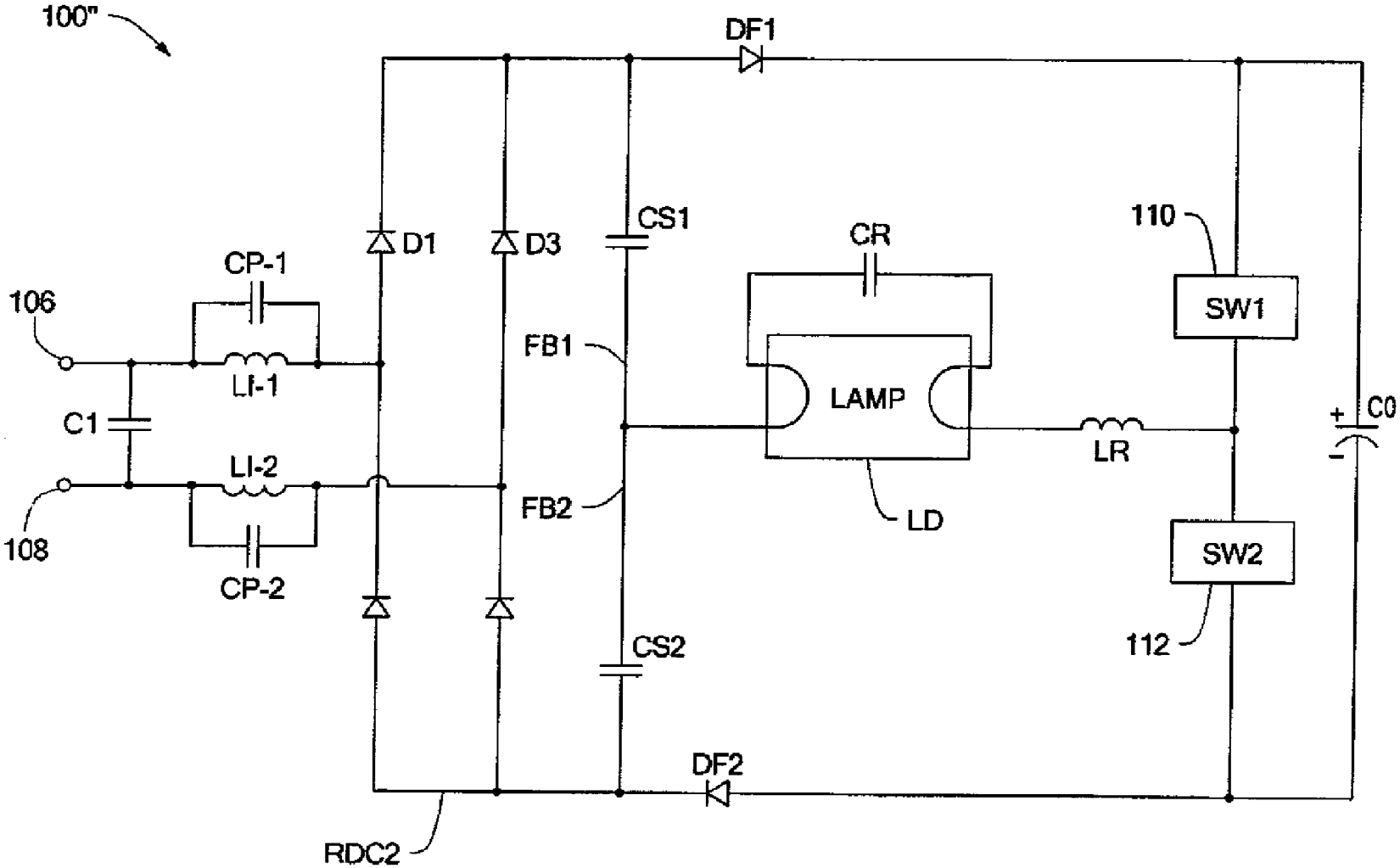
FIG. 4 is a schematic depiction of another circuit having a feedback path in accordance with the present invention.

FIG. 4 shows another embodiment 100" having enhanced linear operation similar to that of FIG. 3, where like reference designations indicate like elements. The circuit 100" includes first and second feedback paths FB1, FB2 from the load LD to respective first and second DC terminals RDC1, RDC2 of the full bridge rectifier D1-D4. The first feedback path FB1 includes a first series capacitor CS1 and the second feedback path FB2 includes a second series capacitor CS2. The circuit 100" further includes a first bridge diode DF1 coupled between the first feedback point RDC1 and the first switching element 110 and a second bridge diode DF2 coupled between second feedback point RDC2 and the second switching element 112.

With this arrangement, the entire feedback from the load can be provided to the rectifying diodes to promote linear operation of the rectifying diodes D1-D4. Notch filters provided by parallel LC resonant circuits tuned to a frequency representative of the feedback signal enable most of the load signal to be fed back, since the notch filter reduces the EMC energy going back out on the line to acceptable levels, even under applicable residential standards.

While the exemplary embodiments show a circuit having EMC-reducing notch filters as parallel resonant LC circuits, it is understood that other resonant circuits can be used to provide the notch filter.

In a further aspect of the invention, a ballast circuit includes a load inductor inductively coupled with a resonant inductor, a resonant capacitor, and a positive temperature coefficient (PTC) element, that combine to promote a soft start sequence for a lamp. With this arrangement preferred voltage and current start up levels are provided to a fluorescent lamp, for example.

Figure 5:
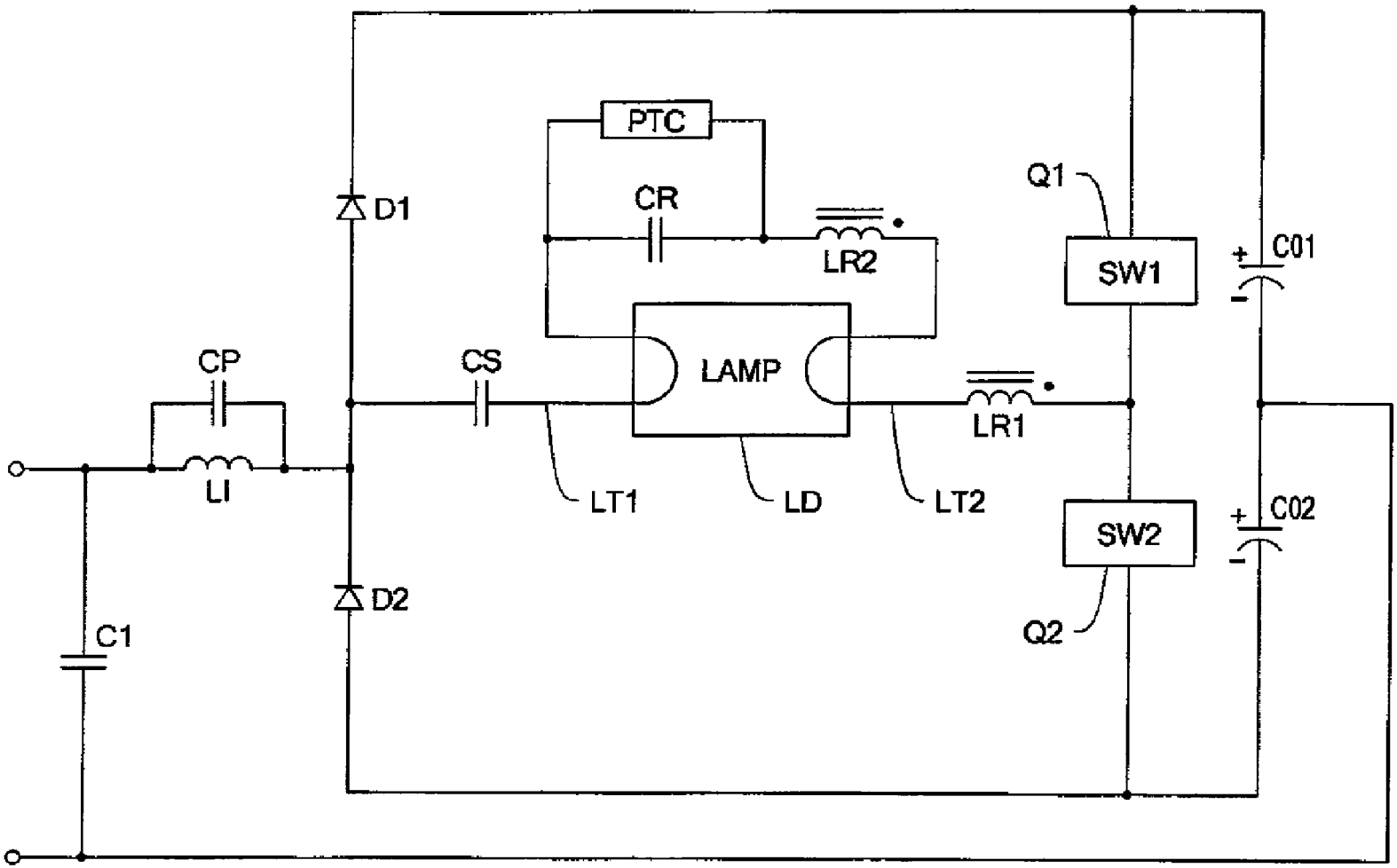
FIG. 5 is a schematic depiction of a circuit providing a soft start in accordance with the present invention.

FIG. 5 shows an exemplary resonant circuit 200, here shown as a ballast circuit, having a lamp start up sequence in accordance with the present invention. The circuit 200 includes a resonant inductor LR1 coupled between first and second switching elements Q1, Q2 coupled in a half-bridge topology. The circuit can further include a conventional input stage having voltage doubler diodes D1, D2, storage capacitors C01, C02, and an LC input filter.

It is understood that the circuit can include various topologies without departing from the present invention. It is further understood that the switching elements can be provided from a wide range of device types well known to one of ordinary skill in the art.

The exemplary circuit 200 further includes first and second load terminals LT1, LT2 across which a load LD, such as a fluorescent lamp, can be energized via a current flow. A resonant capacitor CR and a load inductor LR2 are coupled end-to-end across the first and second load terminals LT1, LT2. The load inductor LR2 is inductively coupled to the resonant inductor LR1. A PTC element PTC is coupled in parallel with the resonant capacitor CR.

Figure 6:
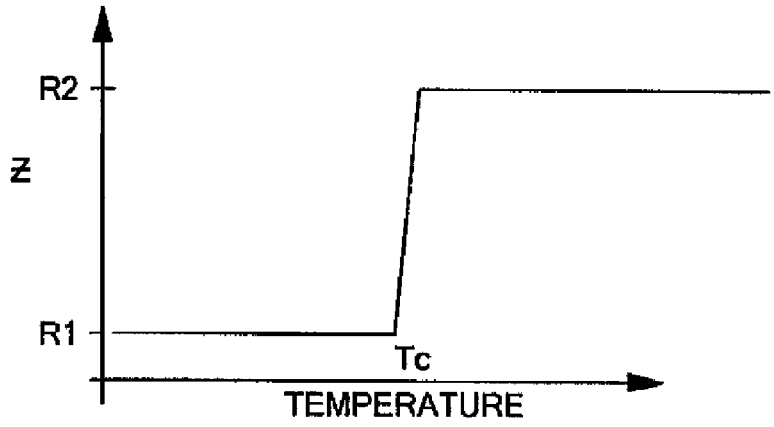
FIG. 6 is a graphical depiction of impedance versus temperature for a positive temperature coefficient element that can form a part of the circuit of FIG. 5.

As is shown in FIG. 6 and known in the art, a PTC element has a first (resistive) impedance R1at a first (lower) temperature range and a second (resistive) impedance R2, which can be significantly higher than the first impedance, at a second (higher) temperature range. In general, at some temperature Tc the PTC impedance dramatically changes from the first impedance R1to the second impedance R2. In an exemplary embodiment, the Tc for the PTC is about 120° C., the cold impedance is about 1 kOhm and the voltage rating is 350 Vrms. One of ordinary skill in the art will readily appreciate that PTC characteristics can be selected to meet the needs of a particular application.

Figure 7A:
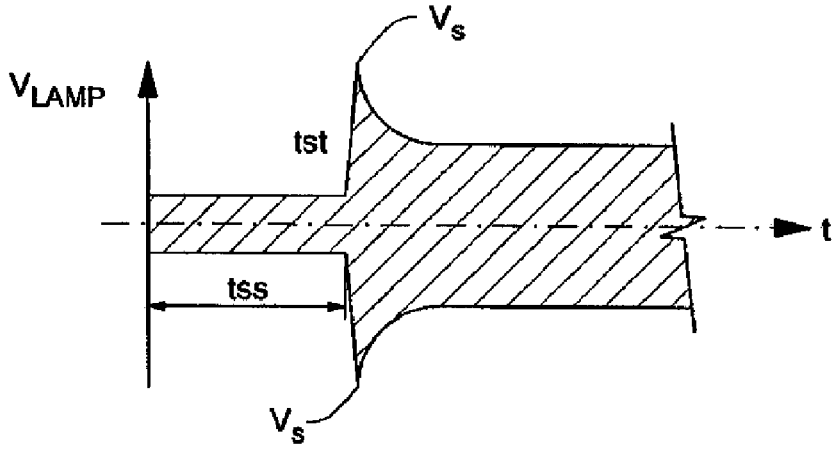
FIG. 7A is a graphical depiction of lamp voltage provided by the circuit of FIG. 5.
Figure 7B:
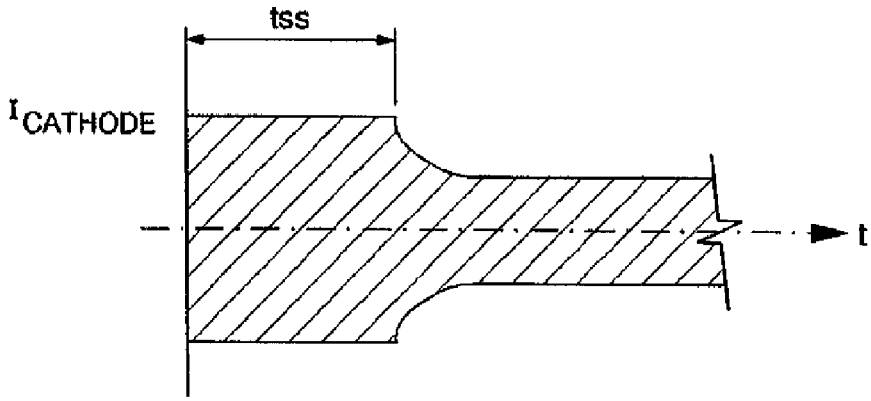
FIG. 7B is a graphical depiction of lamp cathode current provided by the circuit of FIG. 5.

As shown in FIG. 7A, a relatively low voltage Vlamp is applied to the lamp for a soft start time tss and a relatively high initial cathode current level Icathode, which can be referred to as a glow current, simultaneously flows through the lamp cathodes to warm them up for the soft start time tss, e.g., about 0.5 seconds, as shown in FIG. 7B. After the soft start time, the positive temperature coefficient element PTC warms up to the predetermined temperature Tc so that the PTC impedance increases to the second higher level R2. As the PTC element impedance rises dramatically to approach an-open circuit characteristic, a strike voltage Vs is applied to the lamp. After the strike voltage is applied, operational lamp voltage Vlamp levels and cathode current Icathode levels are achieved.

The load inductor LR2 helps define the voltage across the lamp. It is well known that some loads, such as Compact Fluorescent Lamps (CFLs), have a relatively wide operating range. For example, while the current level may fall after dimming the lamp, the voltage across the lamp may not. As is also known, the load voltage has a natural tendency to increase as the operating frequency of the resonant circuit increases. The load inductor L2 resists this voltage elevation since its impedance rises with increases in frequency. Thus, the load inductor LR2 helps maintain a constant circuit operating frequency.

In another aspect of the invention, a resonant circuit includes a clamped feedback signal that provides a load current signal having an envelope substantially tracking an input signal. With this arrangement, the load current signal envelope tracks the input signal to promote linear operation and circuit efficiency even in the presence of storage capacitors.

Figure 8:
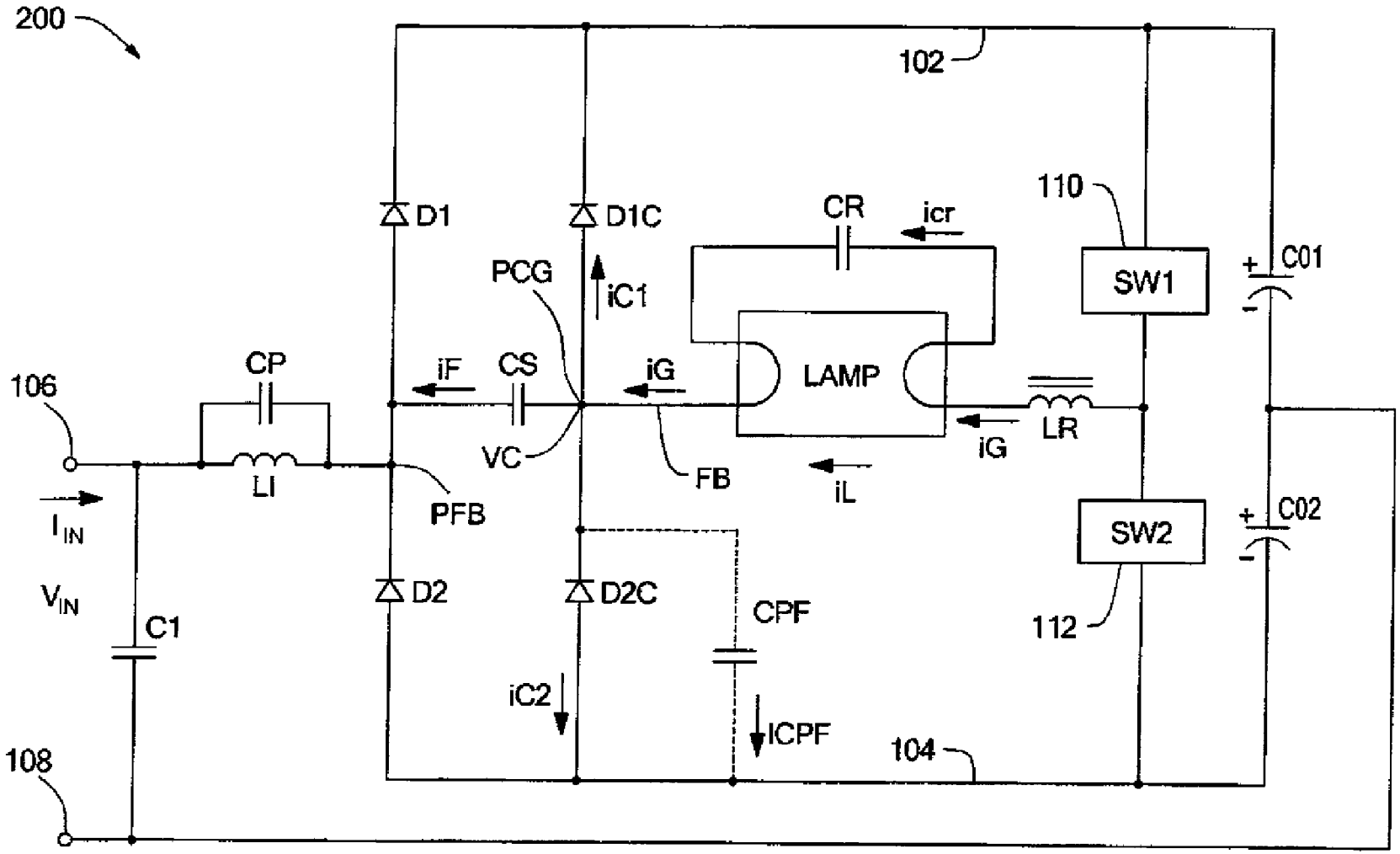
FIG. 8 is a schematic depiction of an exemplary circuit having clamped feedback in accordance with the present invention.

FIG. 8 shows an exemplary resonant circuit 200 having a linear load current signal in accordance with the present invention. FIG. 8 has some commonality with FIG. 2 where like reference numbers indicate like elements. FIG. 8 further includes first and second clamping diodes D1C, D2C coupled end-to-end across the voltage rails 102, 104. A point PCG between the first and second clamping diodes D1C, D2C forms a node between series capacitor CS and the lamp. The circuit 200 can further include an optional impedance, here shown as capacitor CPF, to adjust the feedback signal as described more fully below.

In operation, a global current iG flows through the resonant inductor LR and splits into a resonant capacitor current iCR and a load current iL though the lamp. Coming from the lamp the re-combined global current iG splits at the node PCG between the clamping diodes D1C, D2C into a first clamping current iC1 through the first clamping diode D1C, a second clamping current iC2 through the second clamping diode D2C, and a feedback current iF through the series capacitor CS. In general, the clamping diodes D1C, D2C clamp the voltage VC generated by the global current iG to a voltage determined by the first and second storage capacitors C01, C02.

While arrows for current flow are shown for illustration, it is understood that these currents are alternating currents. In addition, the clamping diodes D1C, D2C are shown as diodes, it is understood that any suitable clamping device, active or passive, can be used. For example, the clamping devices can be provided as controlled power transistors.

Figure 9:
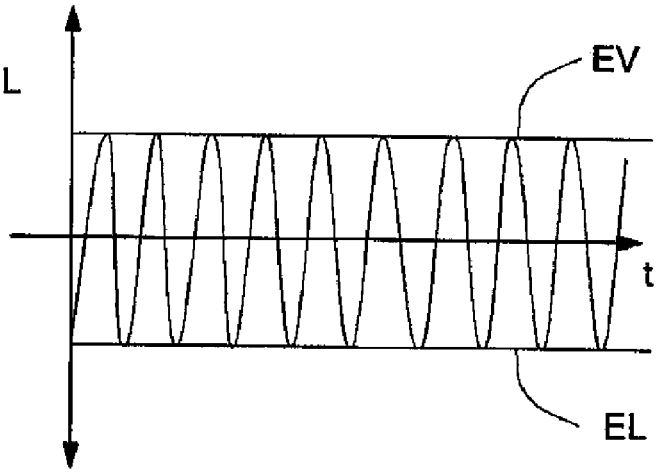
FIG. 9 (PRIOR ART)
FIG. 9 is a graphical depiction of a load current signal generated by a prior art circuit.

Before describing in further detail operation of the inventive circuit, certain disadvantages in known circuits are described. FIG. 9 shows a load current signal iL for a lamp energized by a conventional resonant inverter, for example, having at least one storage capacitor. As is well known to one of ordinary skill in the art, the prior art load current iL has an flat signal envelope EU, EL determined by the storage capacitors. Charge flows to the storage capacitors via the rectifier diodes. While this arrangement is effective to energize the load adequately, the efficiency is less than optimal as the power transfer operation is not linear.

Figure 10:
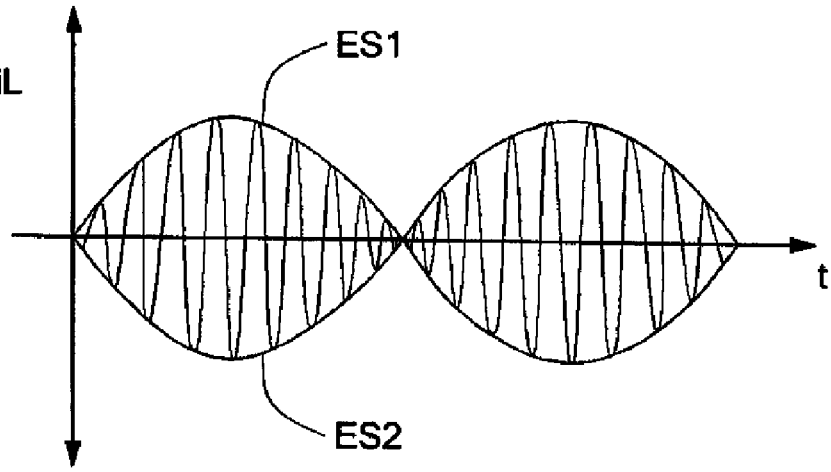
FIG. 10 is a graphical depiction of a linear load current signal generated by a circuit in accordance with the present invention.

In contrast as shown in FIG. 10, the inventive circuit 200 provides a load current signal iL having an envelope ES1, ES2 defined by an input signal, such as a conventional 60 Hz line signal. The high frequency load current iL amplitude tracks the low frequency input signal so as to provide a linear, i.e., resistive load. The advantages of a load current having a substantially sinusoidal envelope will be readily apparent to one of ordinary skill in the art.

Figure 11:
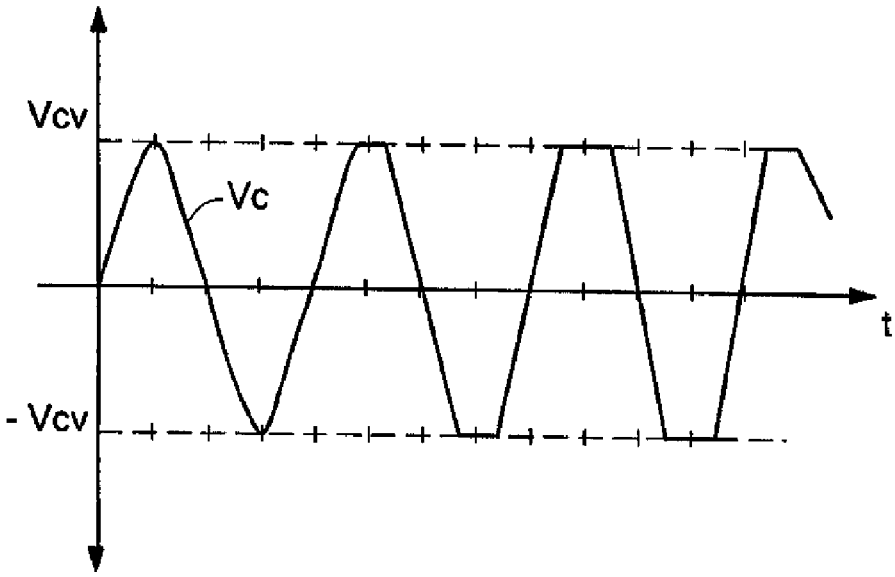
FIG. 11 is a graphical display of a voltage signal at a node in the circuit of FIG. 8.
Figure 12:
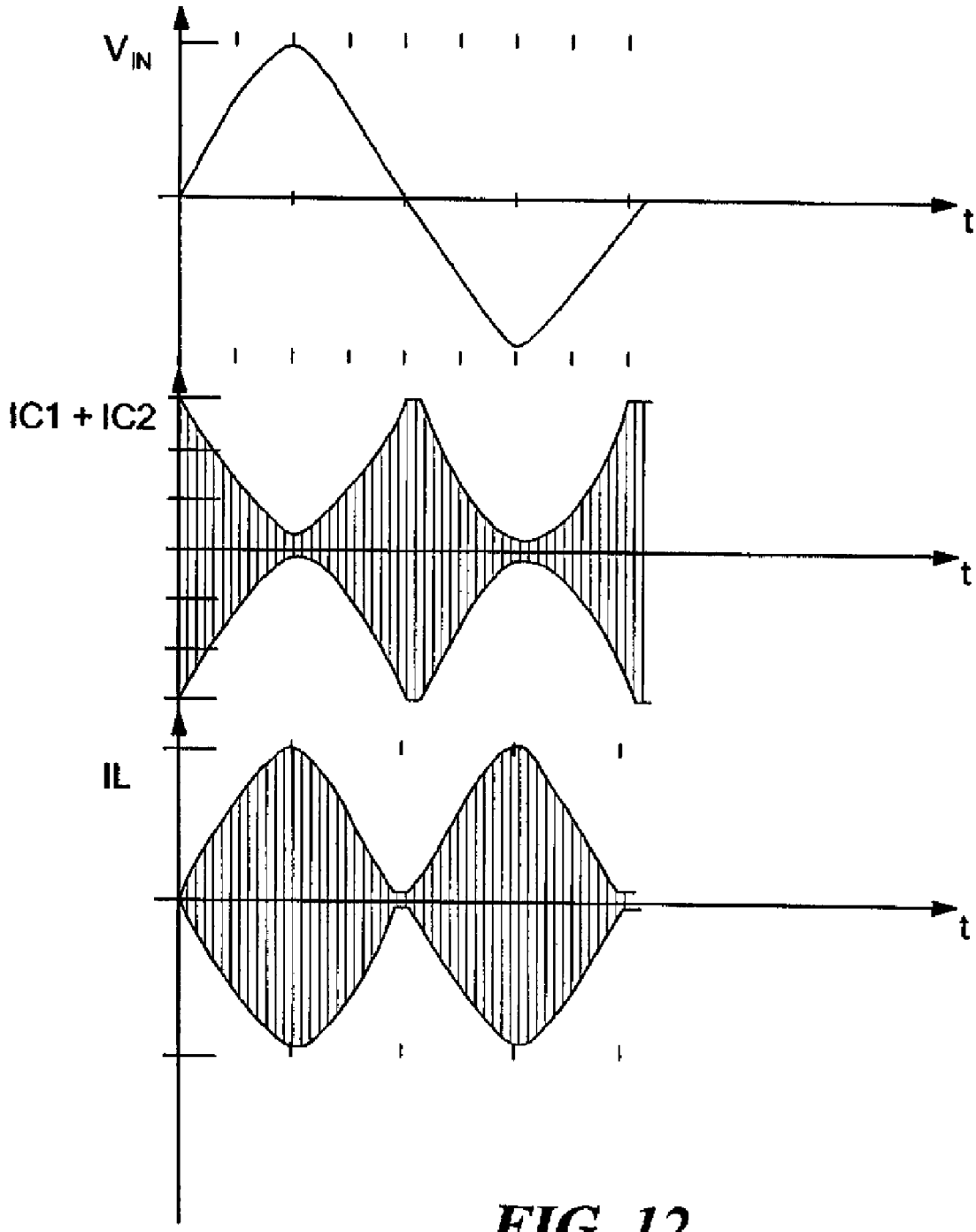
FIG. 12 is a graphical depiction showing a relationship between an input voltage signal, a feedback current signal, and a load current signal.

FIG. 11, in conjunction with FIG. 8, shows the voltage signal VC at the point PCG between the first and second clamping diodes D1C, D2C. As can be seen, the VC voltage signal is clamped to a level VCV set by the charge stored in the first and second storage capacitors C01, C02. FIG. 12 shows the total clamping current iC1+iC2 signal having a signal envelope that is opposite of that of the input voltage signal. As can be seen, iG=iC1+iC2+iF. The instantaneous voltage envelope at point PFB is the same as the input voltage signal VIN since the input inductor L1 is substantially a short circuit at low frequencies, such as 60 Hz. When the input voltage VIN goes to the zero crossing, the voltage drop across the series capacitor CS, which is the difference between the fixed and variable voltages, will force the highest amount of total clamping current. While when the input voltage VIN goes to the peak, it will generate the lowest amount of total clamping current. Thus, the difference between the voltage at node VC and the instantaneous input voltage VIN generates the clamping current iC1+iC2, as shown in FIG. 12. The load current IL is also shown. The impedance of the series capacitor CS determines amount of the feedback current iF. Since the high frequency feedback current IF is constant in amplitude, because of the high impedance of the notch filter L1 and CP, the load current envelope is a generally reverse replica of the envelope of the total clamping current iC1+iC2, thus making it similar to the shape of the input voltage VIN.

While the series capacitor CS is shown as a capacitive element, it is understood that a variety of devices can be used to select a desired impedance for a particular application. For example, particular applications may substitute a component for the series capacitor having an impedance that is not primarily capacitive. This is equally applicable to other circuit components shown in the exemplary embodiments described herein.

With this arrangement, the high frequency load current iL generated by the resonant circuit tracks the sinusoidal input voltage VIN to provide linear circuit operation and thereby enhance the overall efficiency of the circuit. The load current iL tracks the input voltage VIN even in the presence of the storage capacitors, which can sustain resonant circuit operation during zero crossings.

The enhanced efficiency provided by the linear load current is quite advantageous for operations where heat dissipation is an issue, such as dimmable reflectors. The inventive circuit provides less heat, less component stress, and lower EMI (electromagnetic interference).

Figure 13:
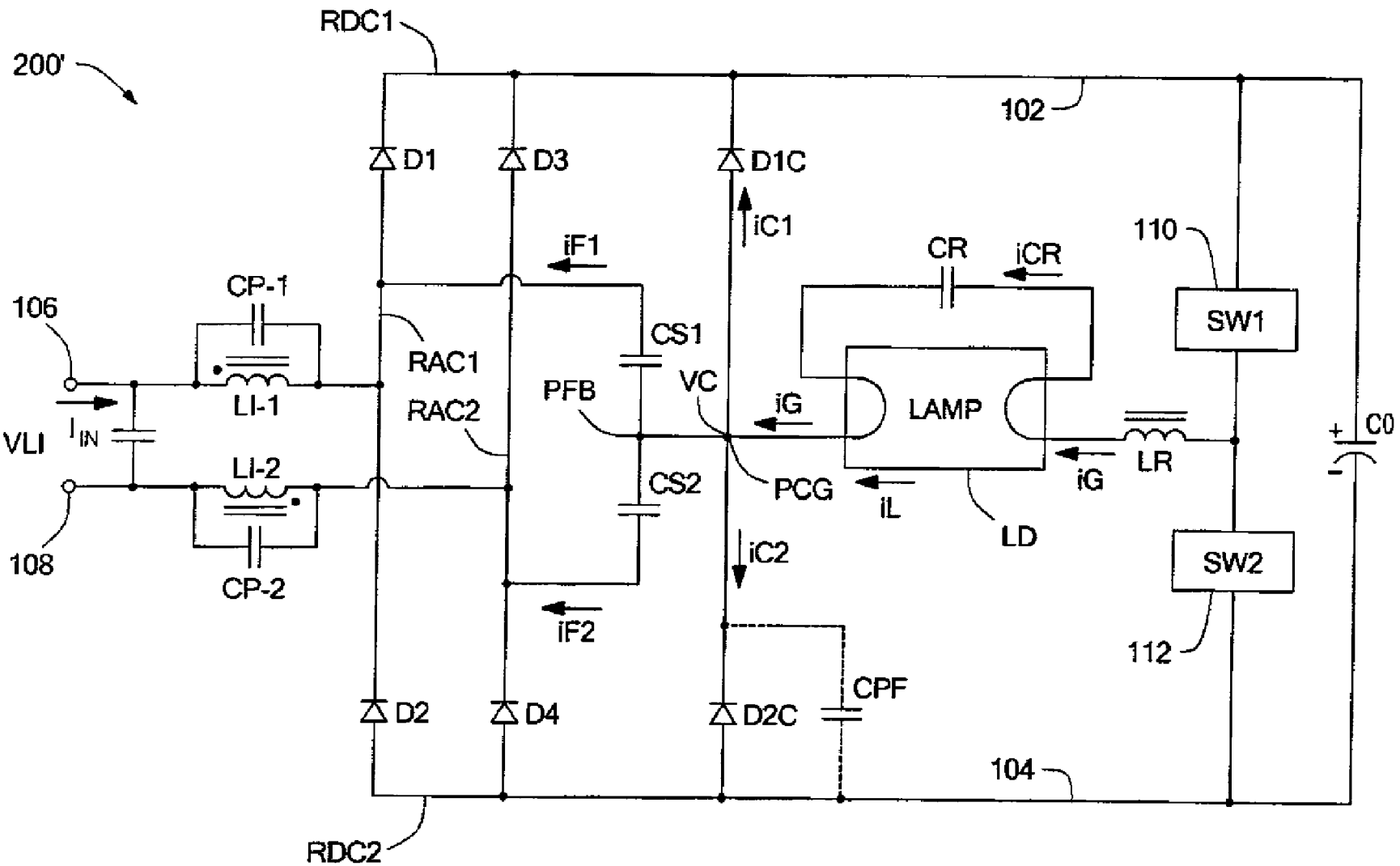
FIG. 13 is a schematic depiction of an exemplary circuit having clamped feedback in accordance with the present invention.

FIG. 13 shows a further resonant circuit 200' having clamped feedback in accordance with the present invention. The resonant circuit 200' has commonality with FIG. 3 and FIG. 8 where like reference numbers indicate like elements. The circuit 200' of FIG. 13 is similar to the circuit 200 of FIG. 8 while having a full bridge rectifier.

Since the circuit 200' has first and second series capacitors CS1, CS2, the feedback current splits into a first feedback current signal iF 1 through the first series capacitor CS1 and a second feedback current signal iF2 through the second series capacitor CS2 back to respective nodes RAC1, RAC2 in the full bridge rectifier. Operation of the circuit 200' will be readily understood by one of ordinary skill in the art in view of the previous descriptions of at least the circuits of FIGS. 3 and 8.

Figure 14:
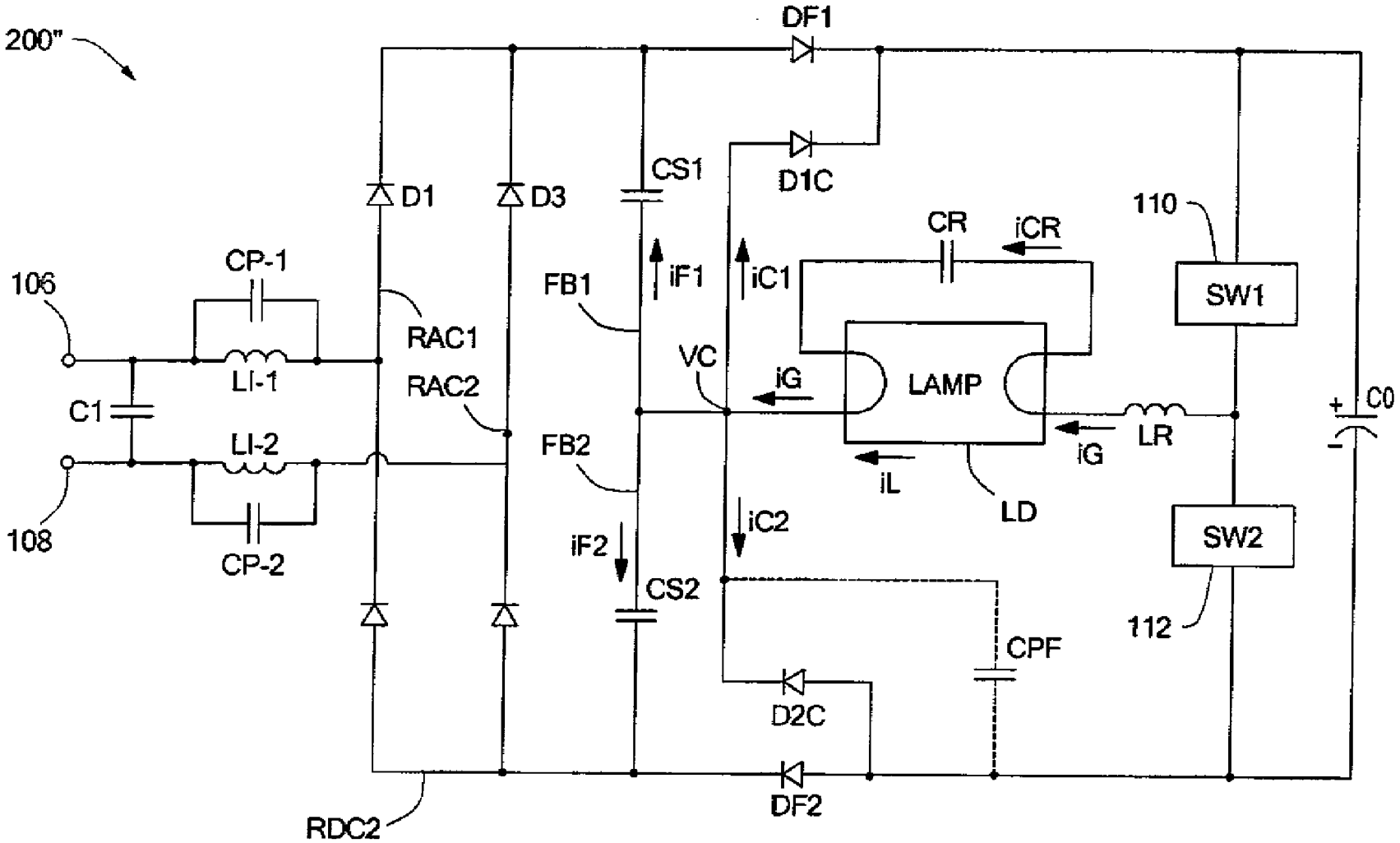
FIG. 14 is a schematic depiction of an exemplary circuit having clamped feedback in accordance with the present invention.

FIG. 14 shows a further embodiment of a resonant circuit 200" having clamped feedback in accordance with the present invention. The circuit 200" has commonality with the circuit of FIG. 4 as well as FIGS. 8 and 13, where like reference numbers indicate like elements. First and second clamping diodes D1C, D2C are coupled end-to-end to the cathodes of the respective first and second bridge diodes DF1, DF2. Operation of this circuit will be readily understood in view of the circuits of FIGS. 4, 8, and 11.

Figure 15:
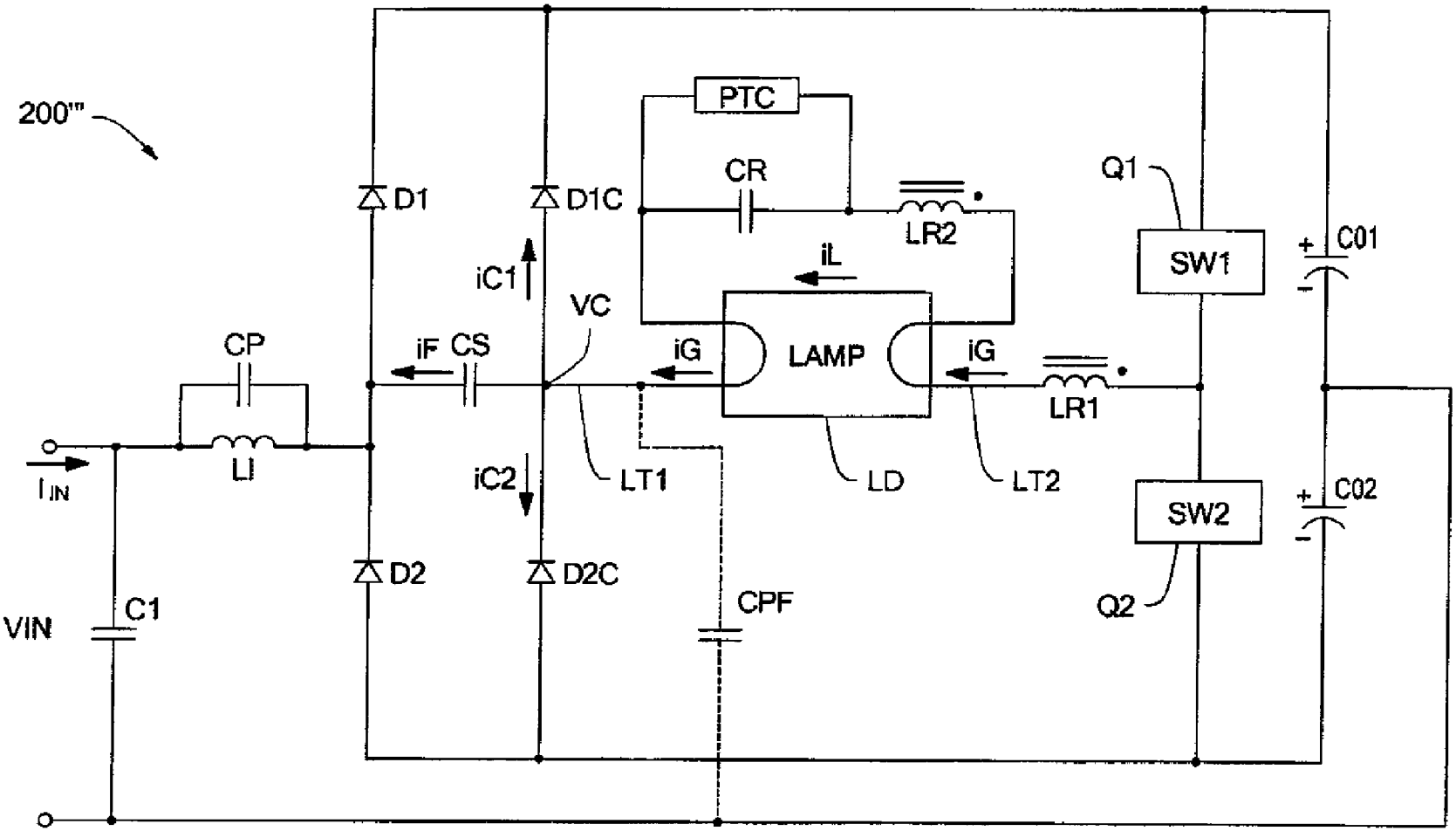
FIG. 15 is a schematic depiction of an exemplary circuit having clamped feedback in accordance with the present invention.

FIG. 15 is another embodiment of a resonant circuit 200'" having clamped feedback in accordance with the present invention. The circuit 200'" includes commonality with the circuit of FIG. 5 as well as the circuit 200 of FIG. 8.

Figure 16:
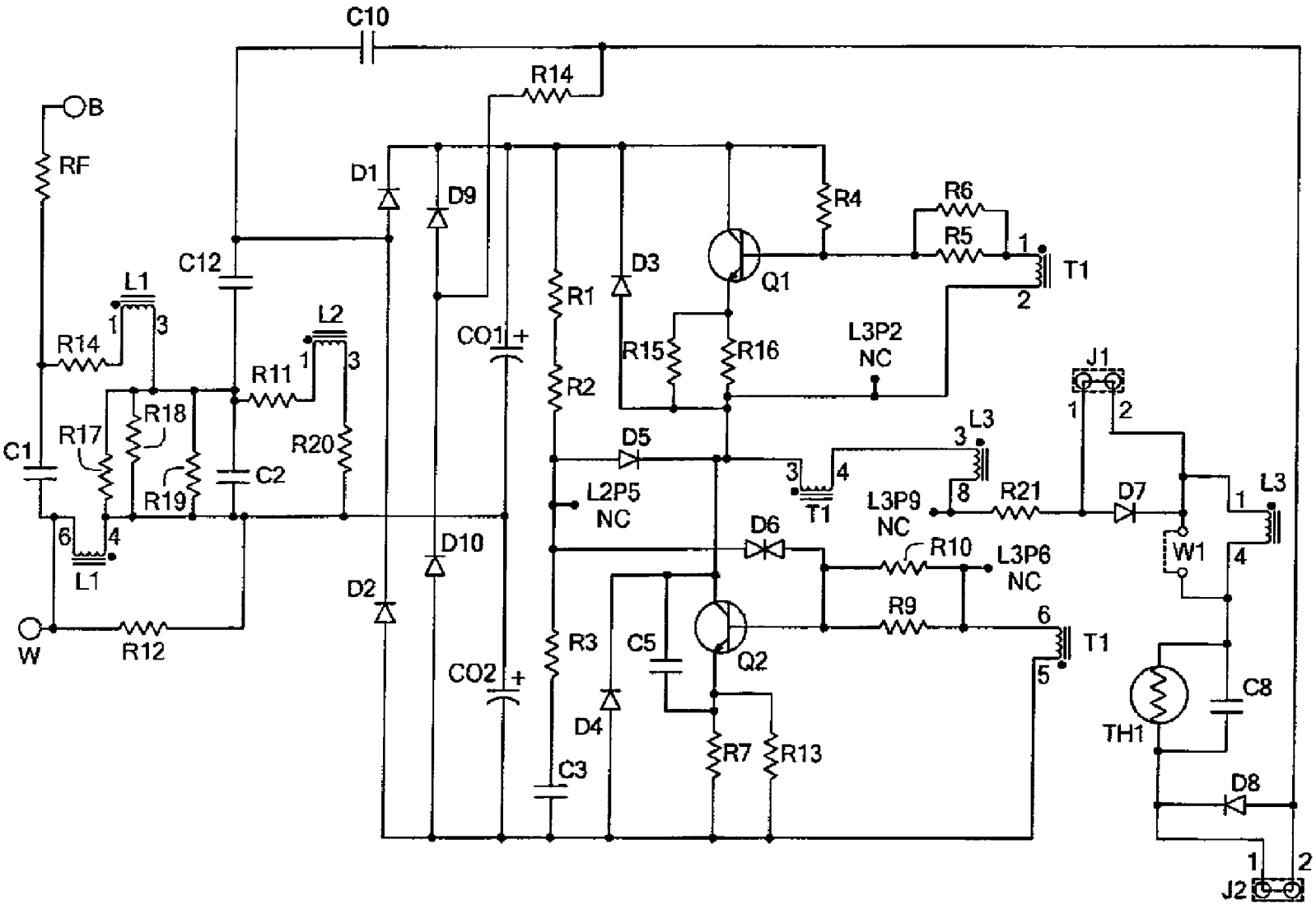
FIG. 16 is an exemplary circuit diagram for the circuit of FIG. 15 in accordance with the present invention.

FIG. 16 shows a circuit diagram for an exemplary implementation of the resonant circuit 200'" of FIG. 15. FIG. 17 shows exemplary component values for the elements of the circuit of FIG. 16

In each of the circuits of FIGS. 8, 13, 14 and 15 an optional feedback adjustment impedance, here shown as a capacitor CPF, can be provided to tweak the feedback current signal iF. It is understood that the impedance can be provided by a wide range of circuit components, both active and passive, having the desired impedance characteristic.

It is understood that the inventive circuits described above with clamped feedback are useful in a wide range of applications. One such application is dimming circuits that adjust a light output level to desired level. While a flat load current may provide some dimming functionality, the advantages provided by a linear load current will be readily apparent to one of ordinary skill in the art.

Figure 18:
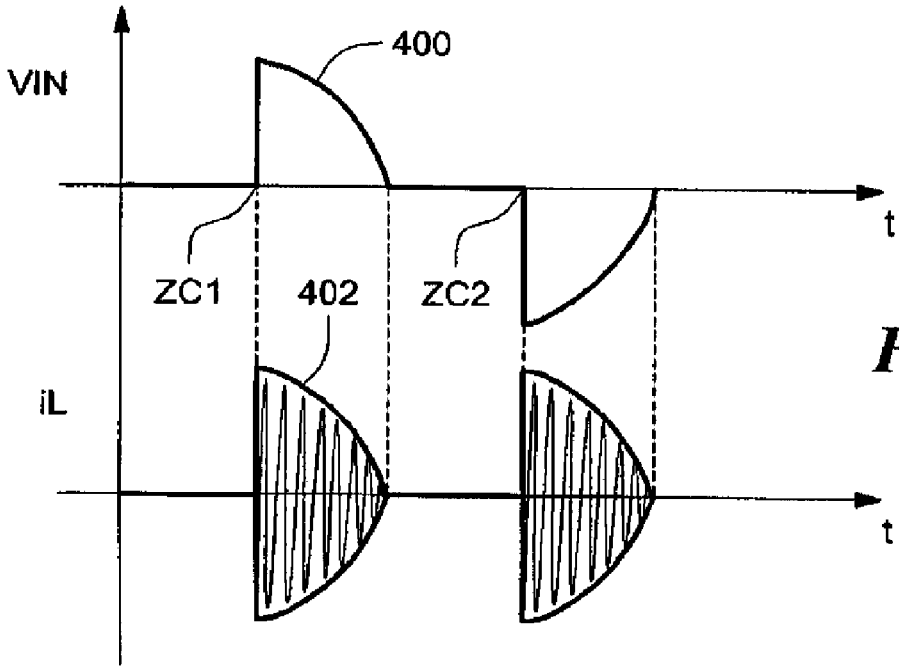
FIG. 18 is a graphical depiction of a load current signal and an input voltage signal for a dimming application in accordance with the present invention.
Figure 19:
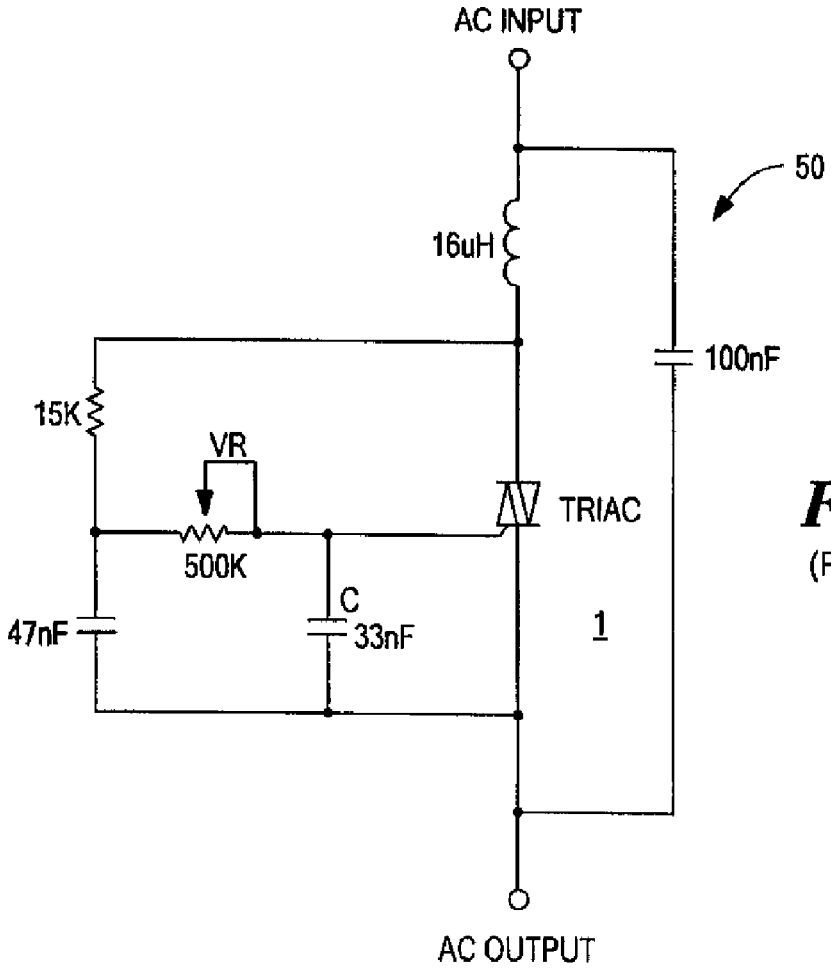
FIG. 19 (PRIOR ART)
FIG. 19 is a schematic diagram of an exemplary prior art dimming circuit.
Figure 19A:
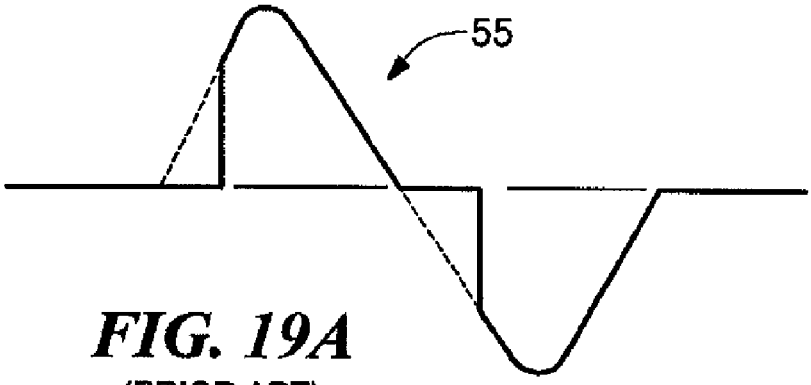
FIG. 19A (PRIOR ART)
FIG. 19A is a graphical depiction of a dimming signal provided by the prior art circuit of FIG. 19.

FIG. 18 shows exemplary waveforms 400, 402 for a dimming application in accordance with the present invention. Dimming circuits providing a dimming input voltage signal 400 are well known in the art. Known circuits for providing a dimming signal are typically triac-based. At a predetermined point, the triac turns on and stays on until the zero crossing ZC1 to energize the load circuit, such as the circuit 200 of FIG. 8. The input signal is off until the triac fires again and stays on until the next zero crossing ZC2. An exemplary prior art dimming circuit 50 is shown in FIG. 19 and a dimming signal output 55 is shown in FIG. 19A. U.S. Pat. No. 6,603,274, which is incorporated herein by reference, also discloses dimming circuits.

Referring again to FIG. 18, the load current 402 in the inventive clamping circuit, such as the circuit 200 of FIG. 8, has en envelope that tracks the input voltage signal. With this arrangement, the load current signal iL is linear when the circuit is energized by the dimming circuit. In a fluorescent lighting application for example, dimming of a fluorescent lamp is comparable to that of an incandescent lamp. One skilled in the art will recognize the advance provided in such an application.

Figure 20:
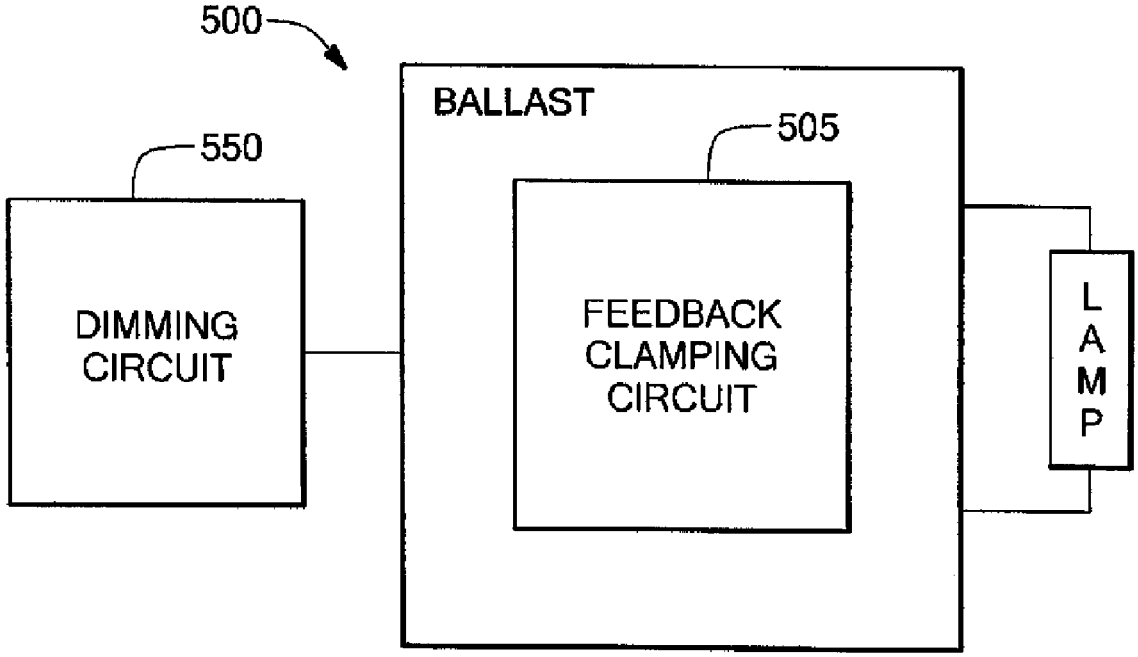
FIG. 20 is a schematic depiction of a ballast having clamped feedback in accordance with the present invention.

FIG. 20 shows an exemplary ballast 500 having a dimming circuit 550 providing an input signal to a feedback clamping circuit 505. It is understood that the clamping circuit 505 can be provided as the circuit 200 of FIG. 8, for example. The ballast 500 energizes a fluorescent lamp and provides enhanced dimming of the lamp.

Figure 21:
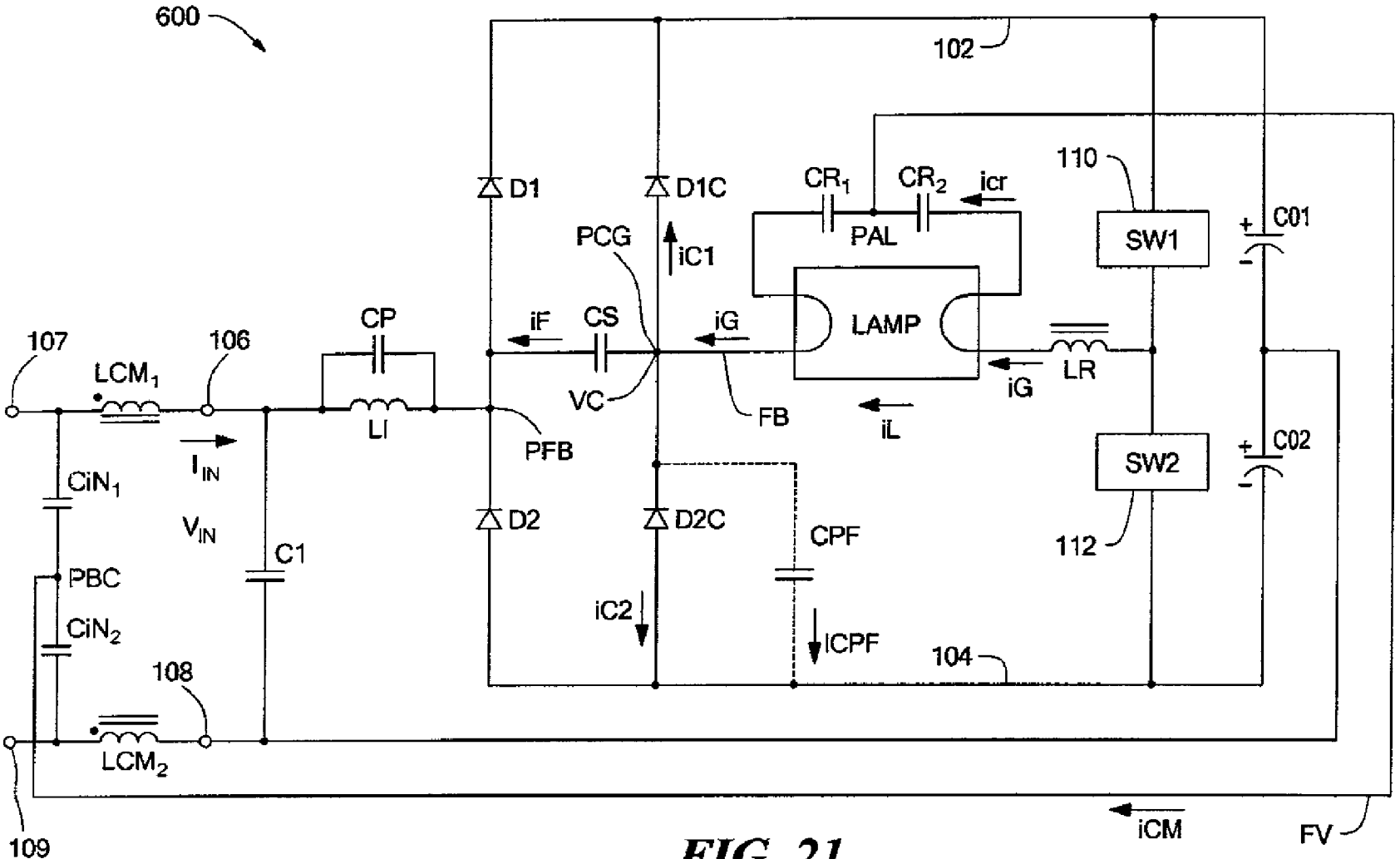
FIG. 21 is a schematic depiction of a ballast circuit having a symmetrical voltage feedback in addition to the clamped feedback, in accordance with the present invention.

FIG. 21 shows an exemplary circuit 600 having a voltage feedback path FV from a first point PAL across the load, here shown as a fluorescent lamp, to a second point PBC between first and second input capacitors $C_{IN}$1, $C_{IN}$2 connecting first and second line terminals 107, 109.

A first inductor $L_{CM}$1 is connected between the first line terminal 107 and a first input terminal 106 and a second inductor $L_{CM}$2 is connected between the second line terminal 109 and a second input terminal 108. The first and second inductors $L_{CM}$1, $L_{CM}$2 could be independent or they could be coupled in a common mode configuration.

The common mode current $I_{CM}$ flowing from the first point PAL to the second point PBC is kept at a relatively low magnitude compared to the magnitude of the load current by proportionally scaling the values of first and second inductors $L_{CM}$1, $L_{CM}$2. By maintaining a relatively low magnitude for the common mode current $I_{CM}$, the voltage feedback created by connecting the first and second points PAL, PBC has no appreciable effect to the operation of the circuit but has an appreciable positive effect in referencing the load to the ground, via the line terminals 107, 109, as the line terminals themselves are referenced to ground in accordance to standard electric codes. Further, the voltage feedback over path FV is applied to the first and second line terminals 107, 109, via the first and second input capacitors $C_{IN}$1 and $C_{IN}$2, in a substantially symmetrical fashion.

The first point PAL is virtually referenced to ground making the voltages at the load terminals against ground approximately equal for approximately equal values of first and second resonant capacitors $C_R$1, $C_R$2. This arrangement operates effectively as a voltage divider by generating approximately equal voltages against ground at the two load terminals.

While the circuit 600 of FIG. 21 is shown having a particular configuration, modifications, substitutions, and variations will be apparent to one of ordinary skill in the art without departing from the present invention. For example, while first and second inductors LCM1, LCM2 are shown, other embodiments may only include single inductive element. Alternatively, additional inductive elements can be utilized in other embodiments. Further, while in one embodiment, first and second capacitors CR1, CR2 have approximately equal impedances, in other embodiments the impedance values can be varied to meet the needs of a particular application.

Figure 22:
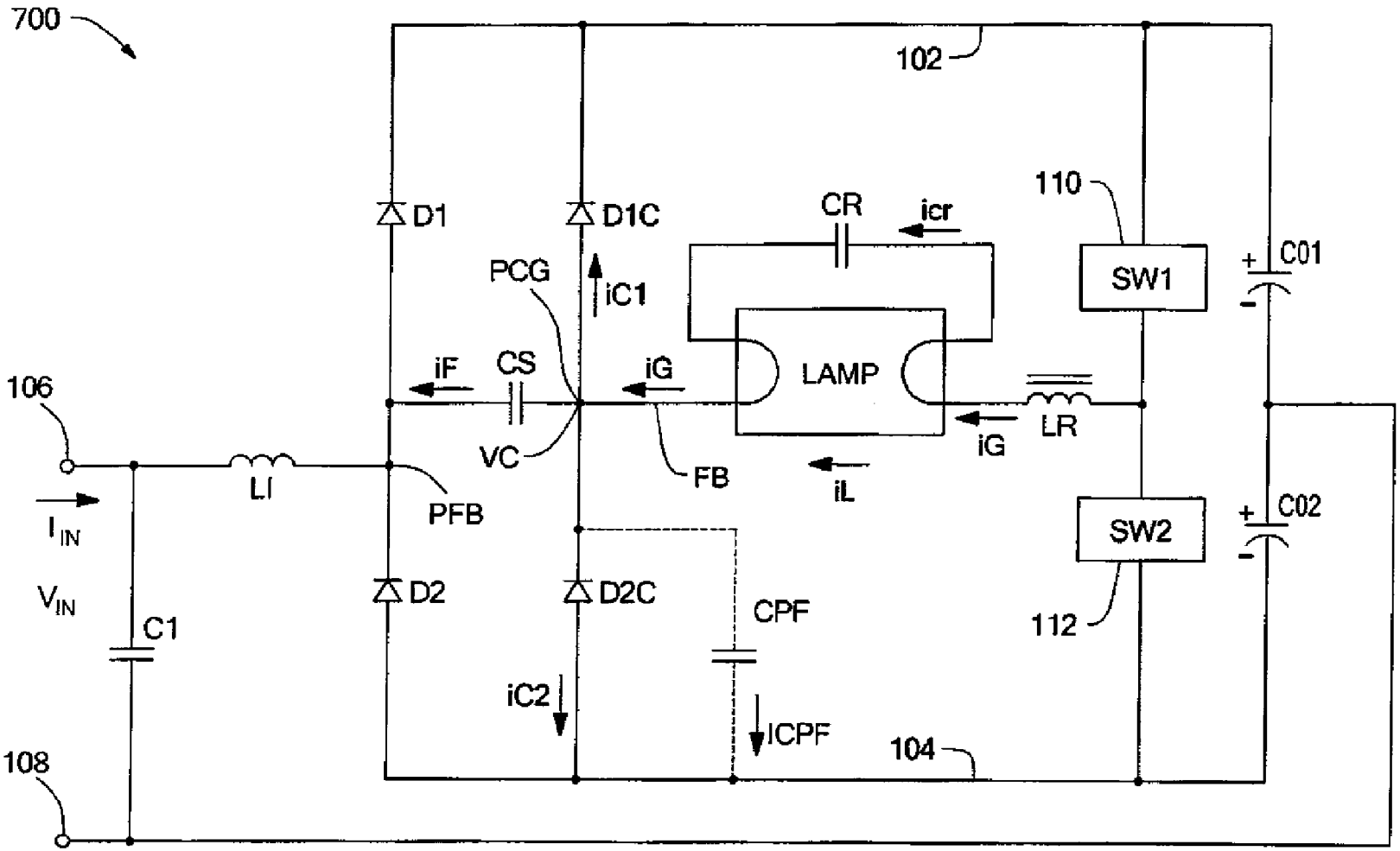
FIG. 22 is a schematic depiction of a ballast circuit having series resonating clamped feedback in accordance with the present invention.

FIG. 22 shows an exemplary circuit 700 having some similarity to the circuit 200 of FIG. 8 with capacitor CP removed. The voltage VC developed at the point PCG is a function of the current iF flowing via the capacitor CS to diodes D1 and D2 and inductor L1, at the circuit operating frequency (fo). The capacitor Cs and the inductor L1 combination naturally resonate together in a series resonating fashion at a given series resonating frequency (fs). By selecting the impedance characteristics of CS and L1 in order to make the series resonating frequency (fs) to be sensibly equal to the circuit operating frequency (fo) and due to the nature of the behavior of the series resonating circuits, the voltage VC at point PCG will sensibly approach the voltage at the input terminal 106. The voltage at the first input terminal 106 on the other hand is referenced to ground and consequently the voltage VC at point PCG will be referenced to ground. In addition, the high frequency voltage at the input terminal 106 is referenced via the capacitor C1 to the point between capacitors C01 and C02, which is a virtual ground.

Figure 23:
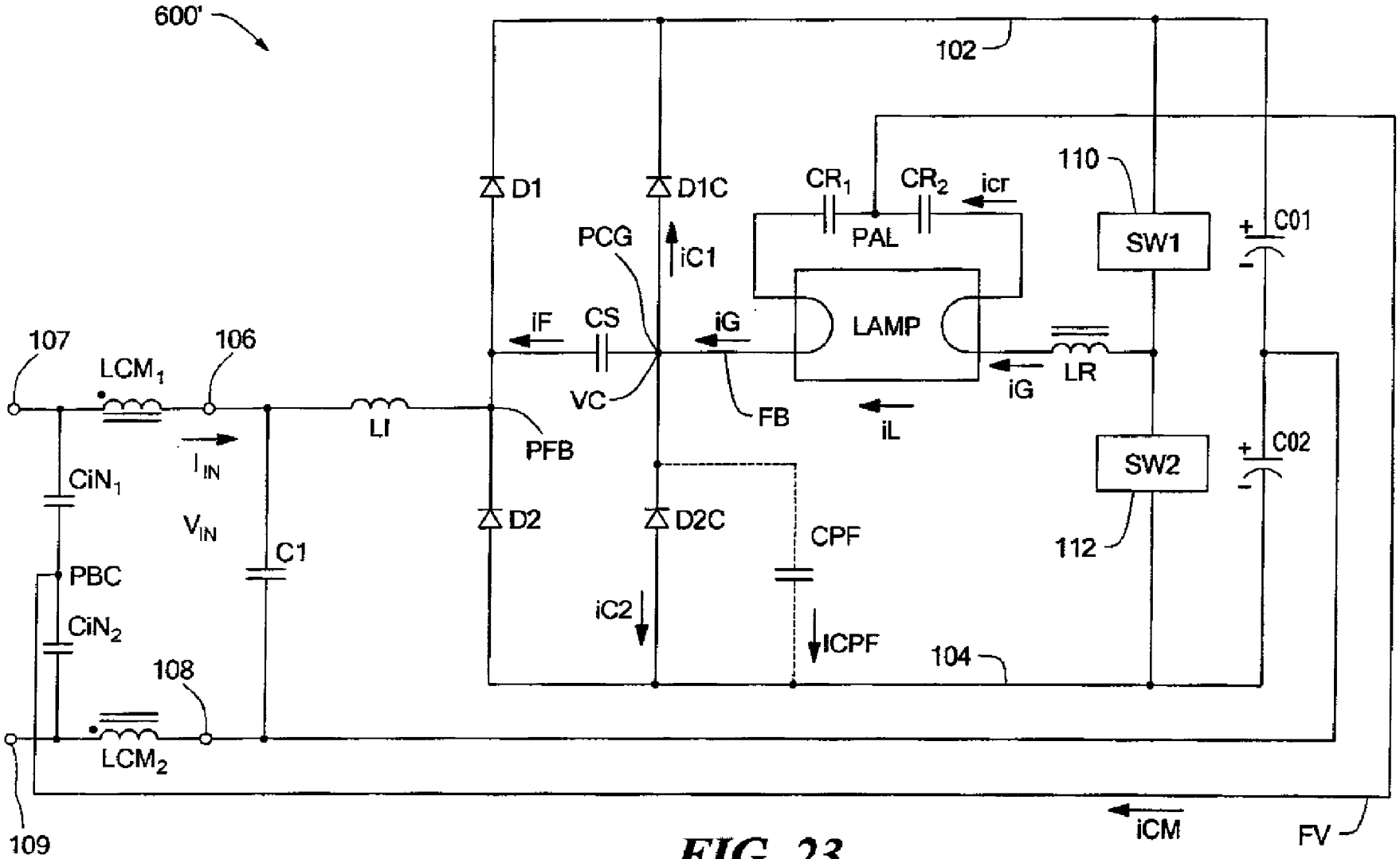
FIG. 23 is a schematic depiction of a ballast circuit having series resonating clamped feedback in combination with a symmetrical voltage feedback in accordance with the present invention.

FIG. 23 shows an exemplary circuit 600', as a combination of the two exemplary circuits 600 and 700 described above in FIGS. 21 and 22. The two ways of referencing the load terminals to ground, namely the series resonating of L1 and CS and the voltage feedback from point PAL to point PBC, are combined in this circuit 600'. As a combined effect, the voltages to ground at the two load terminals could be symmetrically brought down from about 1.6 kVpp to about 300 Vpp, which is well within typical CFL manufacturer specifications.

Figure 24:
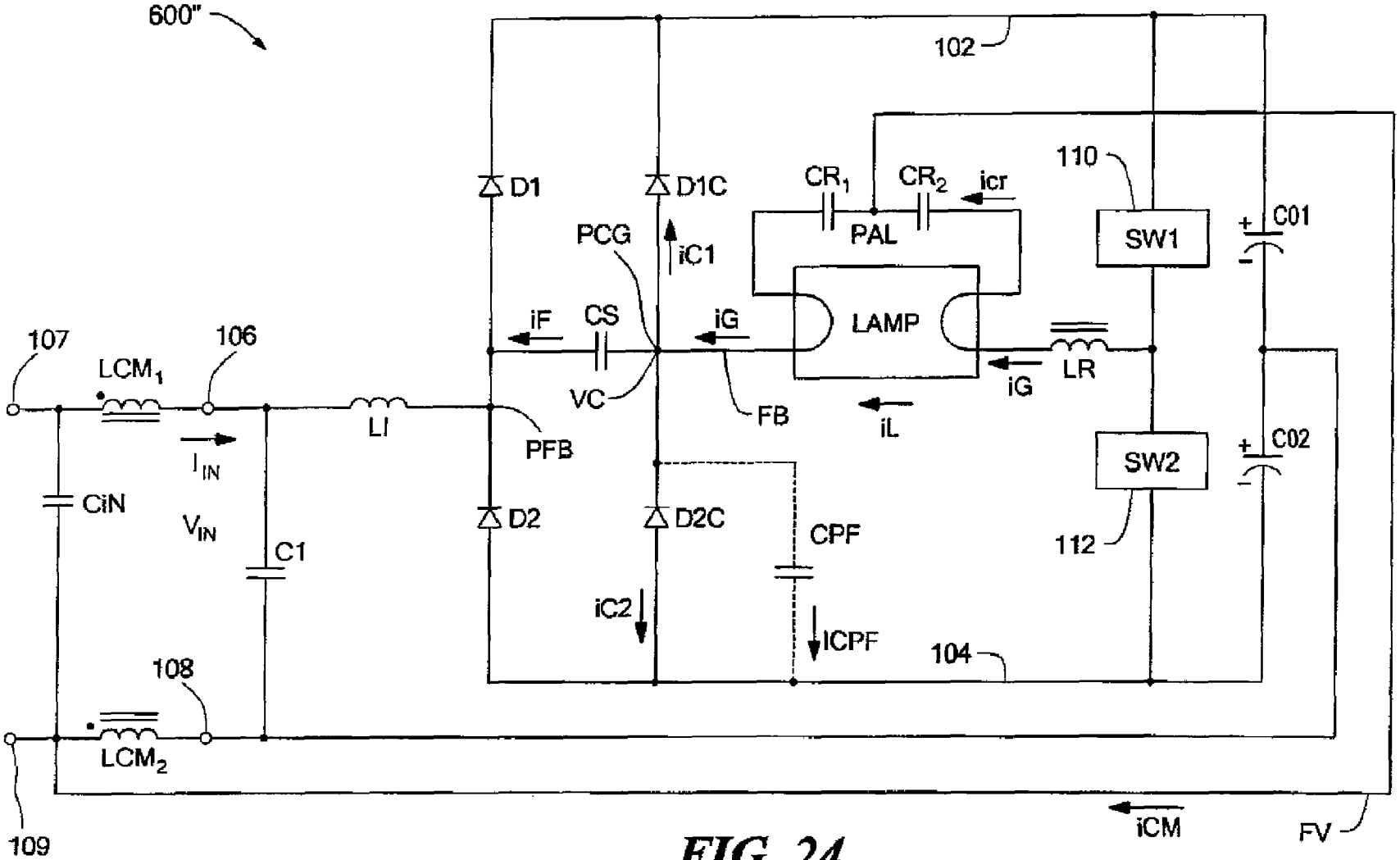
FIG. 24 is a schematic depiction of a ballast circuit having a series resonating clamped feedback in combination with an asymmetrical voltage feedback in accordance with the present invention.

FIG. 24 shows an exemplary circuit 600" that is similar to circuit 600' in FIG. 23. The voltage feedback FV is being taken from the point PAL directly to one of the line terminals, shown as line terminal 109. The same voltage feedback FV could equally be taken to the other line terminal. The fact that the voltage feedback FV is being applied asymmetrically to one of the input terminals does not have any significant effect in referencing the point PAL to the ground. From the high frequency standpoint, the impedance of the capacitor $C_{IN}$ is small enough to have the two line terminals 107 and 109 effectively operating at the same high frequency potential against ground.

The same effect can be achieved by coupling the two inductors $L_{CM}$1 and $L_{CM}$2 in a common mode configuration. With this type of arrangement the capacitor $C_{IN}$ is not even required in order to bring the two line terminals 107 and 109 to operate at the same high frequency potential against ground.

Figure 25:
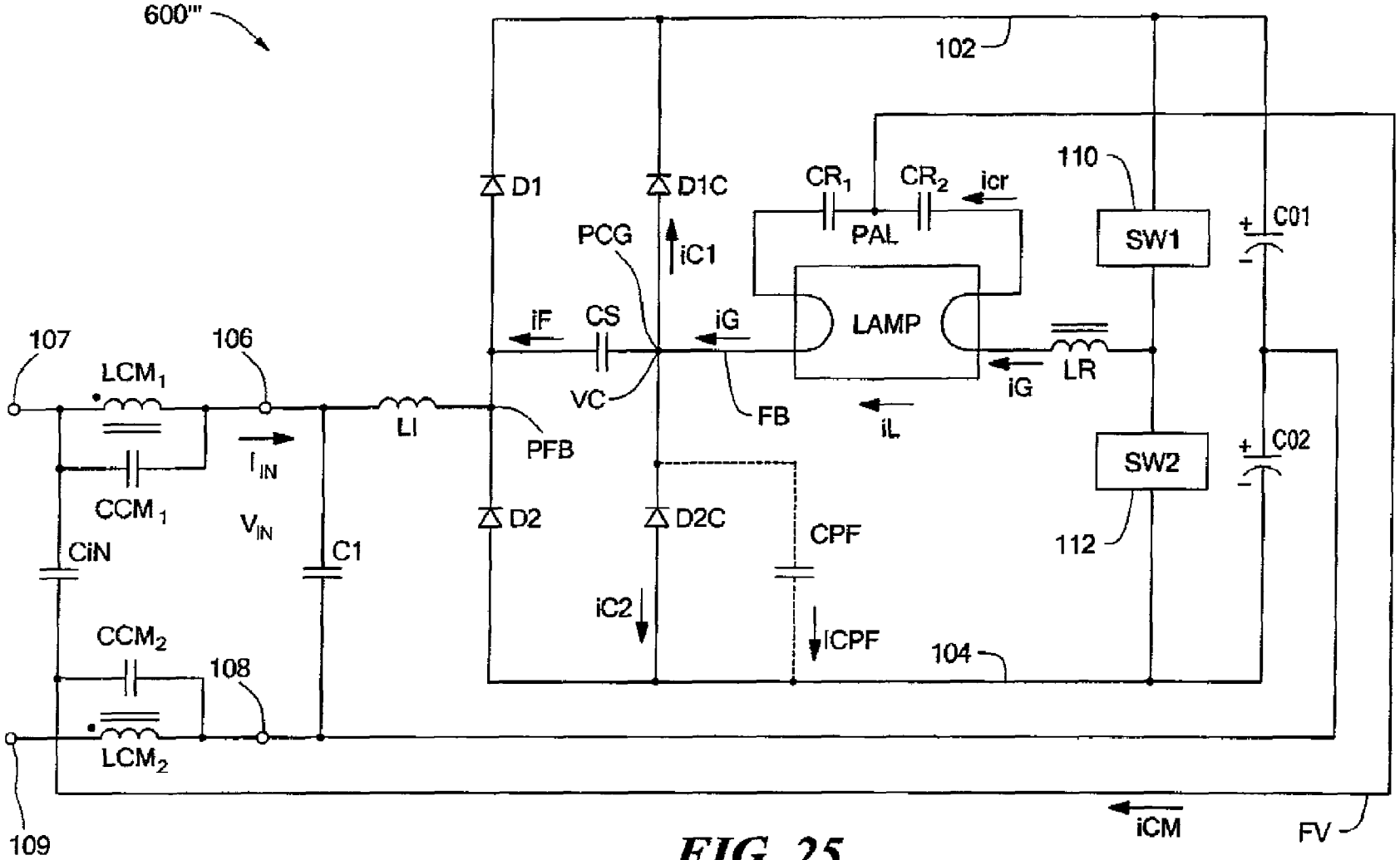
FIG. 25 is a schematic depiction of a ballast circuit having series resonating feedback in combination with an asymmetrical voltage feedback, applied over a parallel combination of resonating elements, in accordance to the present invention.

FIG. 25 shows an exemplary circuit 600'" that is similar to circuit 600" in FIG. 24. It may be sometimes difficult to create high enough impedances across inductors $L_{CM}$1 and $L_{CM}$2, required to minimize the current $I_{CM}$. This difficulty primarily arises from the significant volume required by a high impedance inductor combined with the critical space constraints of any typical CFL application. One way of increasing the impedance of the two inductors and minimizing the volume required to achieve this objective would be to have them built as a single common mode inductor. However, if higher impedance is required at a given frequency, capacitors $C_{CM}$1 and $C_{CM}$2 placed across $L_{CM}$1 and $L_{CM}$2 will help achieve this objective. By properly selecting the values of these components to naturally resonate as two parallel resonating circuits at a frequency (fp) very close to the operating frequency (fo), the equivalent impedances of the two parallel combinations at the operating frequency (fo) will be significantly augmented, by the very nature of the behavior of the parallel resonating circuits. If the two inductors $L_{CM}$1 and $L_{CM}$2 are coupled in a common mode configuration, one single capacitor across one single inductor may suffice to achieve the same objective. One advantage of this configuration is that it provides a very low impedance path to the virtual ground point between capacitors C01 and C02, via capacitors $C_{CM}$1 and $C_{CM}$2, for the higher order harmonics of the operating frequency (fo), thus significantly improving the Electromagnetic Interference (EMI) performance of the circuit.

Figure 26:
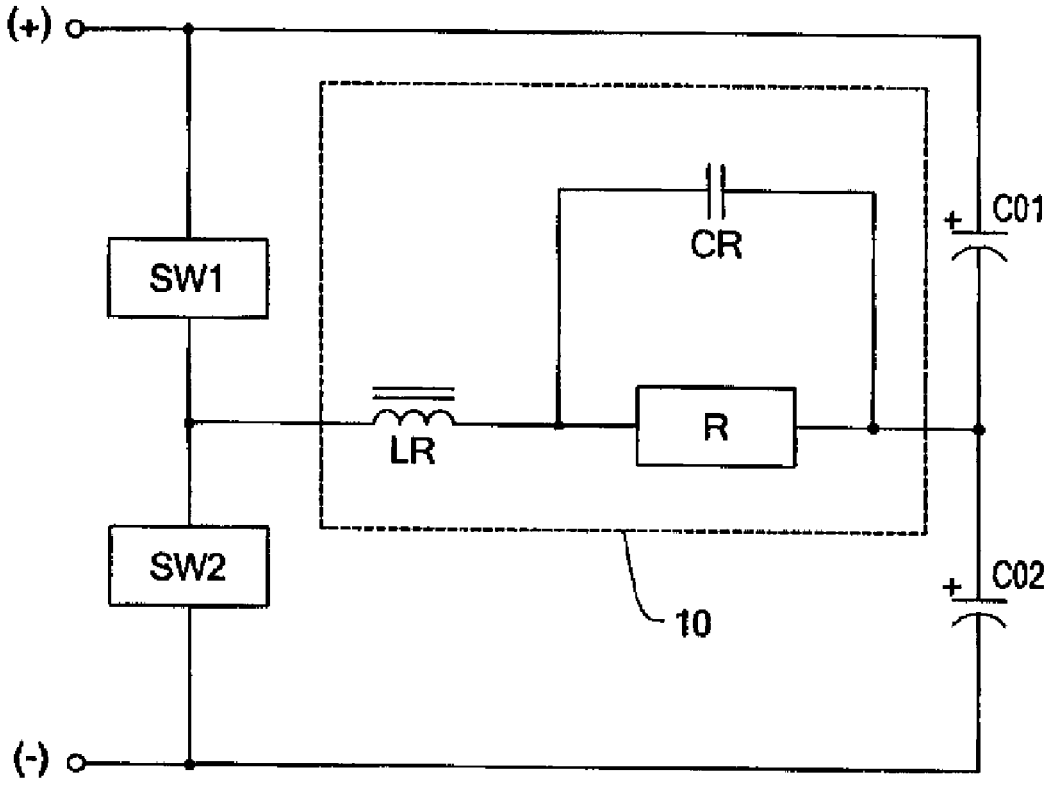
FIG. 26 (PRIOR ART)
FIG. 26 is a schematic depiction of a prior art Parallel Loaded Series Resonating Circuit (PLSRC)

FIG. 26 shows a typical prior art arrangement 10 of a PLSRC: an inductor $L_R$ connected in series with a parallel combination of a capacitor $C_R$ and load R. This typical arrangement draws its name of PLSRC from the fact that the load R is connected in parallel to the resonating capacitor $C_R$. The entire process of resonating takes places between the two reactive elements $L_R$ and $C_R$, with the load R playing a significant role in the way the entire circuit performs. In the illustrated PLSRC circuit, first and second switching elements SW1, SW2 are coupled in a conventional half-bridge configuration.

As is known in the art, there are many advantages but also some disadvantages associated with the operation of typical series resonating circuits. One commonly used topology is the so called Parallel Loaded Series Resonating Circuit (PLSRC) described above, made out of a resonating inductor ($L_R$), a resonating capacitor ($C_R$) and a load (R), which could be a Lamp, connected in parallel to the resonating capacitor.

One purpose in employing this family of circuits is the transfer a relatively high amount of energy from a power source to a load, at a high electrical efficiency factor. The typical efficiency factor of circuits operating in resonating mode can easily exceed 95%, compared to similar switching circuits operating in a pure non-resonating switching mode, where the overall efficiency factor typically reaches values in the range of 70%. By analyzing this entire picture from the perspective of the overall energy loss of 5% on the former topology compared to 30% on the latter technology (a typical ratio of 1:6), one can draw the conclusion that the overall improvement is quite significant.

One limiting factor in transferring energy is determined by the circuit capability of handling the energy loss. A common means of improving on this capability is the use of heat-sinks to dissipate heat and another means is the use of convection fans. However, heat sinks and fans require additional room to operate properly. Furthermore, there are applications where the use of these mechanisms is rendered almost impossible.

One such application is Compact Fluorescent Lamps (CFL) that have significant size and operating temperature constraints. CFLs require a relatively high power per volume density (in the range of 10 W/cubic inch) at a relatively high electrical efficiency (greater than 95%), which render the use of resonating circuit topologies as the preferred economically available choice.

In order to achieve the desired levels of electrical efficiency the circuit obviously presents certain design challenges. There are several characteristic frequencies that describe the operation of this circuit. One characteristic frequency is the resonating frequency (fr) which, by definition, is the reverse of the square root (sqrt.) of the product between LR and CR: fr=1/sqrt(LR*CR). This frequency is fixed, or characteristic to the circuit, as the reactive elements LR and CR are fixed.

Another characteristic frequency is the operating frequency (fo), primarily set by the circuit designer. This frequency is usually fixed if the power transferred to the load is fixed or steady, or variable if the power transferred to the load is variable, like in light dimming applications. A further characteristic frequency is the so called "zero phase" frequency (fz), which represents the frequency at which the phase angle of the complex impedance Z of the PLSRC is zero. At this particular frequency the circuit impedance Z is no longer reactive but purely active. In other words, it behaves like a pure resistor, even though there are two reactive elements ($L_R$ and $C_R$) in its composition. At this particular frequency the current in the circuit and the voltage across the circuit are in phase. There is a particular value of the circuit impedance Z, which is called the characteristic impedance and is defined as the square root of the ratio between the resonating inductor $L_R$ and the resonating capacitor $C_R$: $Zc=\mathrm{sqrt}(L_R/C_R)$. This characteristic impedance is fixed and well defined for fixed resonating elements and it is not frequency dependent, since the elements $L_R$ and $C_R$ are not frequency dependent.

One desirable operating frequency is the zero phase frequency (fo=fz), for the following reasons:

- the entire current flowing through the circuit is active, in other words it entirely reaches the load (R), as there is no reactive current since the phase angle is zero. This current represents the minimum possible current magnitude needed to transfer any given amount of power to the load.
- the switching elements (SW1 and SW2) operate under the best possible conditions, at zero crossing. In other words, the current flowing to the switching elements is virtually zero when they switch from the OFF state to the ON state and vice-versa. This creates the minimum switching loss.
- the parasitic losses through the reactive element $L_R$ (like core losses and copper losses) and $C_R$ are reduced to a minimum, since the current flowing through them is at the minimum possible magnitude.

All these considerations above set the zero phase frequency (fz) as a desirable frequency for operating the circuit.

As it can easily be demonstrated by those knowledgeable in the art, the square (sq.) of the ratio between the zero phase frequency (fz) and the resonating frequency (fr) equals number one minus the square of the ratio between the resonating circuit characteristic impedance Zc and the impedance of the load R: sq(fz/fr)=1−sq.(Zc/R). Based on this relationship, it can be seen that the zero phase frequency (fz) is highly dependent on the magnitude R of the load, as the other elements like (fr) and Zc are constant and characteristic to the magnitudes of the resonating elements. Another conclusion drawn from the relationship above is that the zero phase frequency is always to be found below the resonating frequency and approaching it as the magnitude R of the load increases: fz<fr. For a totally unloaded circuit, when the load is removed, the zero phase frequency (fz) coincides with the resonating frequency (fr) or fz=fr.

For practical reasons though, operating the circuit at the zero phase frequency precisely, is challenging. In order to appreciate this challenge, one needs to further understand the way the circuit behaves at operating frequencies above and below the zero phase frequency.

A theoretical and practical evaluation of this type of circuit leads to the conclusion that the circuit has to operate at frequencies (fo) above the zero phase frequency (fz), or fo>fz.

Operating the circuit at a frequency (fo) below the zero phase frequency (fz), in other words in a negative phase operating condition, is leading to the switching elements SW1, SW2 conducting simultaneously. This phenomenon is also known as "cross-conduction". As it is well known in the art, cross-conduction can lead to the self-destruction of the switching elements, because of the high level of power dissipated across them.

On the other hand, bringing the operating frequency (fo) above the resonating frequency (fr) will yield to a poor overall efficiency. For practical reasons, the operating frequency (fo) has be set above the zero phase frequency (fz), ideally very close to it but below the resonating frequency (fr) for the reasons mentioned above. The relationship describing the ideal positioning of the operating frequency can be expressed as: fr>fo>fz.

The above conclusions hold valid for a steady power transfer scenario, where the load (R) and the zero phase frequency (fz) are well defined. However, this scenario may be far from reflecting the real life scenarios, especially for CFL applications.

CFLs are well known for the very dynamic behavior of the load impedance (R). This is due to manufacturing variations and the aging process. As the lamp ages, the magnitude of the load impedance (R) goes up significantly. This in turn, will push the zero phase frequency (fz) upwards. If the operating frequency (fo) of a driven circuit has been originally set just above the original zero phase frequency (fz) in order to improve on the efficiency, chances are that, as the lamp ages, a drifting zero phase frequency (fz) will eventually end up above the operating frequency (fo), leading to cross-conduction and circuit failure.

The problem becomes even more critical as a dimming function is desired and implemented. As mentioned above, the magnitude of the load (lamp) impedance (R) significantly increases as the lamp current decreases. As a matter of fact, the lamp voltage significantly increases as the lamp current decreases, accelerating the increase of the lamp impedance.

Figure 27:
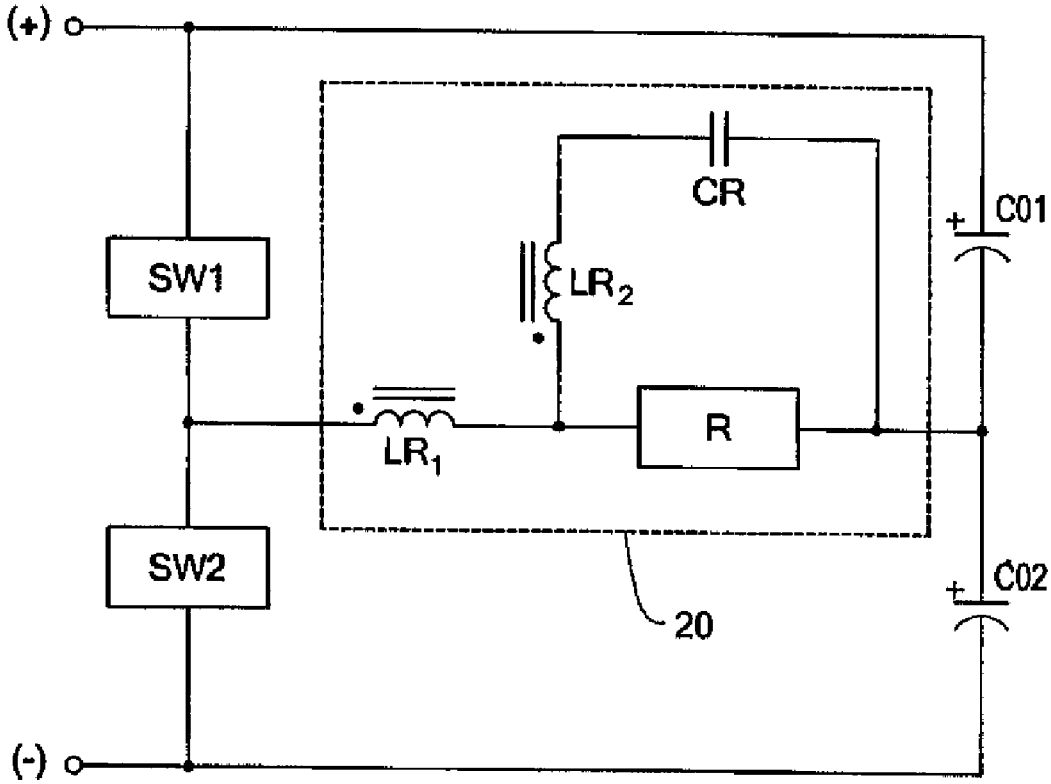
FIG. 27 is a schematic depiction of a Split Inductor Resonating Circuit (SPRC) in accordance to the present invention.

FIG. 27, which has some similarity with the circuit 200''' of FIG. 15, shows an exemplary arrangement of a "Split Inductor Resonating Circuit", which can be referred as a SIRC, comprising a primary resonating inductor $L_R$1 connected in series with a parallel combination of a load R and a series combination of a secondary resonating inductor $L_R$2 (connected in phase with $L_R$1) and a resonating capacitor $C_R$.

As the load R and the resonating elements are set to transfer full power, the load has a "masking effect" on the secondary resonating inductor $L_R$2 as being connected in parallel to $L_R$2 via $C_R$. As the load impedance magnitude R increases, due to aging or to dimming of the load (lamp), the "masking effect" of the load to the secondary resonating inductor $L_R$2 becomes less noticeable, allowing for the $L_R$2 in phase combination with $L_R$1 to effectively increase the total equivalent magnitude of the resonating inductance, operating as an equivalent resonating inductor. This circuit effectively implements a load-controlled resonating inductor. As the load magnitude increases so does the total equivalent resonating inductor made out of the in phase combination of $L_R$1 and $L_R$2.

Based on the relationship defining the zero phase frequency (fz), this synchronized increase in the equivalent magnitude of the resonating inductance, as the magnitude of the load R increases, will keep the drifting upwards of the zero phase frequency in check by maintaining the critical relationship fo>fz, allowing for the circuit to operate without slipping into a self-destructive "cross-conduction" mode described above.

Figure 28:
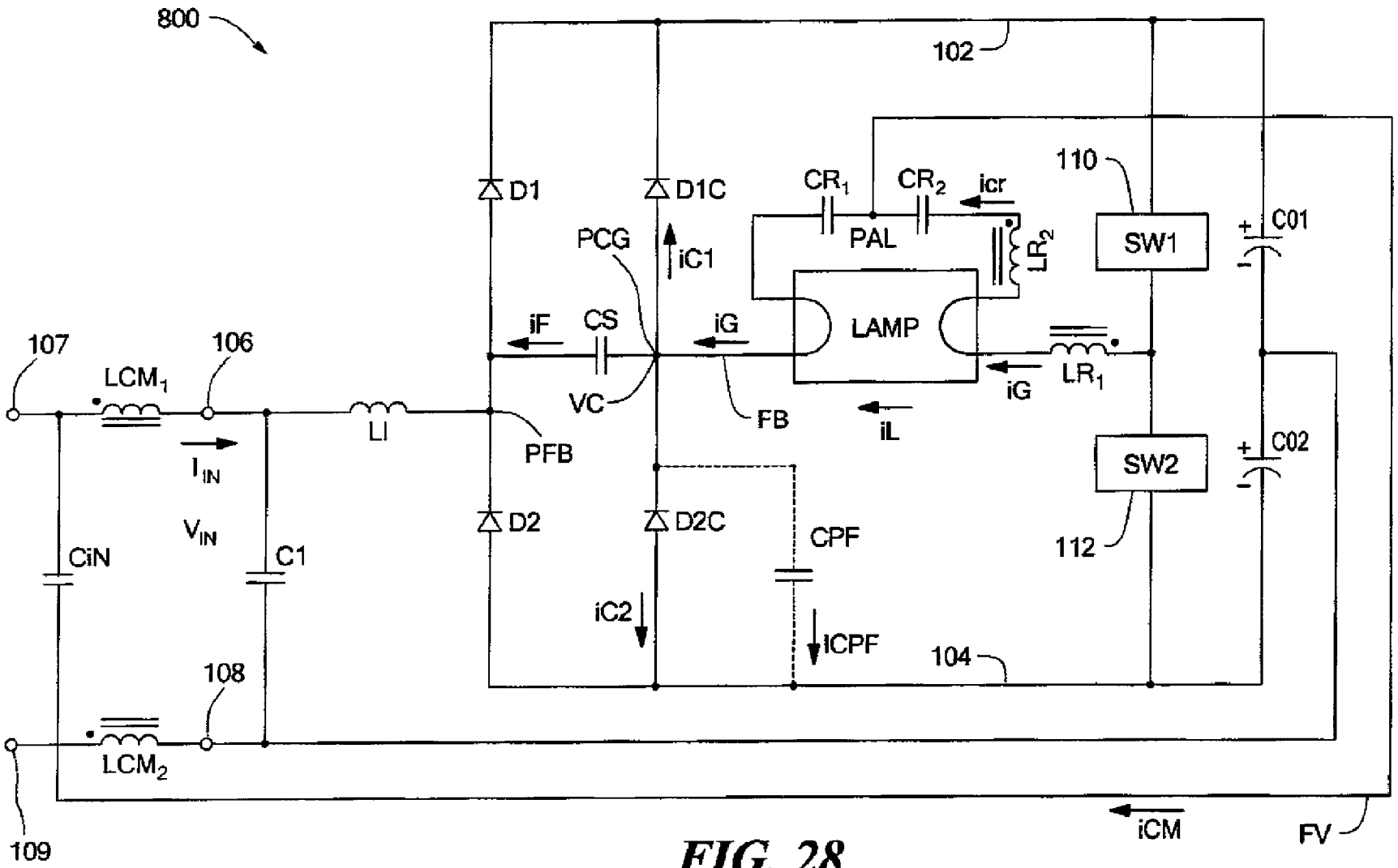
FIG. 28 is a schematic depiction of a ballast circuit having series resonating feedback in combination with an asymmetrical voltage feedback, taken from a combination of split resonating capacitors and a Split Resonating Inductor elements, in accordance with the present invention.

FIG. 28 shows an exemplary circuit 800 having some similarity to the circuit 600" in FIG. 25 and the circuit 20 of FIG. 27. An inductor LR2, coupled in phase with inductor LR1, is connected between inductor LR1 and one of the resonating capacitors, CR2 in this case. Inductors LR1 and LR2 are connected in phase, which means that the total voltage across the combination of two is greater than the voltage across each individual inductor. As the load impedance goes up, which can happen for a variety of reasons, the circuit is protected against slipping into a self-destructive "cross-conduction" operating mode where the first and second switching elements SW1, SW2 are conductive simultaneously.

Exemplary values for components in the various embodiments are set forth below. It will be readily appreciated that impedance values can be modified by one of ordinary skill in the art to meet the needs of a particular application.

LCM1/LCM2>40 mH
LI=2.0 mH
CS=2.2 nF
CR1/CR2=4.7 nF
LR=2.3 mH
LR1=2.3 mH
LR2=1.0 mH
CIN1/CIN2=0.1 uF
C1=0.1 uF
C01/C02=33 uF/250V
CIN=0.1 uF
CCM1/CCM2=330 pF

Embodiments of the invention provide a circuit and method to clamp global load feedback such that the load current signal has an envelope the substantially tracks an input voltage signal. This arrangement enhances linear operation of the circuit so as to concomitantly increase efficiency. While the invention is described in conjunction with ballast circuits for fluorescent lamps, it is understood that the invention is applicable to a wide range of circuits in which it is desirable to promote linear operation. In addition, while the exemplary embodiments include storage capacitors to sustain the circuit through zero crossings for example, it is contemplated that circuits ultimately may not need storage capacitors.

Embodiments of the invention provide a circuit and method to significantly reduce the voltages against ground at the load terminals to a value effectively equal to half of the load voltage. The circuit behaves as if a virtual point across the load would be connected to ground. This arrangement eliminates the parasitic leakage from the load terminals to ground and improves on the overall Electromagnetic Interference (EMI) overall circuit performance.

Embodiments of the invention also provide for an effective way of preventing the circuit from slipping into a self-destructive "cross-conduction" way of operation as the magnitude of the load impedance increases.

One skilled in the art will appreciate further features and advantages of the invention based on the above-described embodiments. Accordingly, the invention is not to be limited by what has been particularly shown and described. All publications and references cited herein are expressly incorporated herein by reference in their entirety.

What is claimed is:

1. A circuit comprising:

first and second line terminals and first and second input terminals, a first impedance element connected between the first line terminal and the first input terminal and a second impedance element connected between the second line terminal and the second input terminal;

a rectifier circuit coupled to the first and second input terminals;

a resonant circuit coupled to the rectifier circuit, the resonant circuit including a resonant inductor, a resonant capacitor, and first and second rails, first and second load terminals to enable the resonant circuit to energize a load;

wherein the resonant capacitor includes first and second resonant capacitors coupled in series across the first and second load terminals; and a voltage feedback path for a feedback signal extending from a point between the first and second resonant capacitors to a point between the first and second line terminals so that a potential at the load substantially tracks a potential at the first and second input terminals, wherein at least one of the first and second impedance elements is connected inside the feedback loop so as to impede feedback current from flowing through the voltage feedback path.

2. The circuit according to claim 1, wherein at least one input capacitor is connected across the first and second line terminals.

3. The circuit according to claim 1, wherein at least two input capacitors are connected in series across the first and second line terminals and the feedback path extends to a point between the at least two input capacitors.

4. The circuit according to claim 1, wherein the first impedance element includes a first inductor and the second impedance element includes a second inductor.

5. The circuit according to claim 4, wherein the first and second inductors are coupled together in a common mode configuration.

6. The circuit according to claim 1, wherein the circuit forms a part of a ballast to energize a compact fluorescent lamp.

7. The circuit according to claim 1, wherein the first and second resonant capacitors have substantially equal impedances.

* * * * *

UNITED STATES PATENT AND TRADEMARK OFFICE

CERTIFICATE OF CORRECTION

PATENT NO. : 7,642,728 B2
APPLICATION NO. : 11/169413
DATED : January 5, 2010
INVENTOR(S) : Mihail S. Moisin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 163 days.

Signed and Sealed this

Twenty-first Day of December, 2010

David J. Kappos

David J. Kappos
*Director of the United States Patent and Trademark Office*